US007926226B2

(12) United States Patent
Pope

(10) Patent No.: US 7,926,226 B2
(45) **Date of Patent: *Apr. 19, 2011**

(54) DEPLOYABLE PREFABRICATED STRUCTURE WITH AN EXTENSION STRUCTURE THAT IS SEALABLE TO THE PREFABRICATED STRUCTURE UPON DEPLOYMENT FROM THE PREFABRICATED STRUCTURE

(75) Inventor: James D. Pope, San Francisco, CA (US)

(73) Assignee: Green Horizon Manufacturing, LLC, San Francisco, CA (US)

( * ) Notice: Subject to any disclaimer, the term of this patent is extended or adjusted under 35 U.S.C. 154(b) by 211 days.

This patent is subject to a terminal disclaimer.

(21) Appl. No.: 12/250,484

(22) Filed: Oct. 13, 2008

(65) Prior Publication Data

US 2010/0024315 A1 Feb. 4, 2010

Related U.S. Application Data

(60) Provisional application No. 61/084,532, filed on Jul. 29, 2008.

(51) Int. Cl.
*E04B 1/346* (2006.01)

(52) U.S. Cl. ..... 52/67; 52/64; 52/79.1; 52/79.5

(58) Field of Classification Search ..... 52/64, 66, 52/67, 69, 79.1, 79.12, 79.14, 79.5, 175, 52/236.3, 475.1, 479, 480, 474, 506.1, 506.06, 52/574, 650.3

See application file for complete search history.

(56) References Cited

U.S. PATENT DOCUMENTS 1,279,819 A 9/1918 Zingsheim et al.

(Continued)

FOREIGN PATENT DOCUMENTS

JP 09032325 A 2/1997

(Continued)

OTHER PUBLICATIONS

International Search Report and Written Opinion, in connection with PCT/US2009/051870, mailed Dec. 16, 2009, 11 pages.

*Primary Examiner* — Brian E Glessner
*Assistant Examiner* — James J Buckle, Jr.
(74) *Attorney, Agent, or Firm* — Fliesler Meyer LLP

(57) ABSTRACT

A prefabricated structure comprises a shell including a shell frame and an extension including an extension frame deployable from the shell. The shell frame comprises a floor support, a roof support, and a plurality of columns extending between the floor support and the roof support, forming corners of the shell frame. A flange extends from at least one of the columns. The extension frame comprises a floor support, a roof support, and a plurality of columns extending between the floor support and the roof support, forming at least one corner of the extension frame. An outer lip is associated with at least one column of the extension farthest from the shell when the extension is deployed. An inner lip is associated with at least one column of the extension closest to the shell when the extension is deployed. The flange provides a first pocket for receiving the outer lip when the extension is seated within the shell and a second pocket receives the inner lip when the extension is deployed from the shell. The first pocket includes a first gasket to seal the prefabricated structure when the outer lip is received within the first pocket and the second pocket including a second gasket to seal the prefabricated structure when the inner lip is received within the second pocket.

20 Claims, 29 Drawing Sheets

U.S. PATENT DOCUMENTS 2,167,557 A 7/1939 Stout
2,636,773 A * 4/1953 Van Tassel ..... 296/172
2,704,223 A 3/1955 Houdart
2,732,251 A 1/1956 Meaker
2,813,747 A 11/1957 Rice
2,842,972 A 7/1958 Houdart
2,890,498 A 6/1959 Bigelow
2,901,282 A 8/1959 Meaker
3,106,750 A 10/1963 Jarman
3,169,280 A 2/1965 Jarman
3,181,910 A * 5/1965 Thomas ..... 52/67
3,304,668 A 2/1967 Edmonds
3,421,268 A * 1/1969 Reynolds et al. ..... 52/70
3,560,043 A 2/1971 Harter
3,596,416 A 8/1971 Hojka
3,650,556 A 3/1972 Ratcliff
3,719,386 A 3/1973 Puckett et al.
3,866,365 A 2/1975 Honigman
3,924,366 A 12/1975 Gibbs
3,941,414 A 3/1976 Platt
4,017,116 A 4/1977 Hulsey
4,049,310 A 9/1977 Yoder
4,075,814 A 2/1978 Theurer et al.
4,500,132 A 2/1985 Yoder
4,534,141 A 8/1985 Fagnoni
4,545,171 A 10/1985 Colvin
4,603,518 A 8/1986 Fennes
4,638,607 A * 1/1987 Hadjiiski et al. ..... 52/79.9
4,726,158 A * 2/1988 Fagnoni ..... 52/79.5
4,829,726 A * 5/1989 de Potter d'Indoye ..... 52/66
4,850,268 A 7/1989 Saito et al.
4,930,837 A 6/1990 Marsh et al.
4,955,661 A 9/1990 Mattice
4,958,874 A 9/1990 Hegedus
5,061,001 A 10/1991 Madden et al.
5,090,749 A 2/1992 Lee
5,106,142 A 4/1992 Hegedus
5,154,469 A 10/1992 Morrow
5,170,901 A * 12/1992 Bersani ..... 220/1.5
5,185,973 A 2/1993 Oldani
5,237,782 A 8/1993 Cooper
5,280,985 A 1/1994 Morris
5,291,701 A 3/1994 Delacollette et al.
5,295,430 A 3/1994 Dewald, Jr. et al.
5,332,276 A 7/1994 Blodgett, Jr.
5,333,420 A 8/1994 Eden
5,345,730 A * 9/1994 Jurgensen ..... 52/64
5,491,933 A 2/1996 Miller et al.
5,577,351 A 11/1996 Dewald, Jr. et al.
5,596,844 A 1/1997 Kalinowski
5,620,224 A 4/1997 DiBiagio et al.
5,658,032 A * 8/1997 Gardner ..... 296/26.01
5,706,612 A 1/1998 Tillett
5,727,353 A * 3/1998 Getz et al. ..... 52/79.1
5,732,839 A 3/1998 Schimmang et al.
5,761,854 A 6/1998 Johnson et al.
5,797,224 A * 8/1998 Gunthardt ..... 52/79.4
5,815,988 A 10/1998 Molina
5,921,033 A 7/1999 Molina
5,964,065 A 10/1999 Migurski et al.
5,966,956 A 10/1999 Morris et al.
5,984,396 A 11/1999 Schneider
6,003,919 A 12/1999 Shook
6,048,167 A 4/2000 Lesmeister et al.
6,052,952 A 4/2000 Frerichs et al.
6,116,671 A 9/2000 Schneider
6,135,525 A 10/2000 Amann
6,209,939 B1 4/2001 Wacker
6,224,126 B1 5/2001 Martin et al.
6,266,931 B1 7/2001 Erickson et al.
6,286,883 B1 9/2001 Schneider et al.
6,293,612 B1 9/2001 Crean
6,338,523 B1 1/2002 Rasmussen
6,393,769 B1 * 5/2002 Mertik et al. ..... 52/7
6,428,073 B1 8/2002 Blodgett, Jr.
6,494,334 B1 * 12/2002 Cheng ..... 220/1.5
6,494,518 B2 12/2002 Kreil et al.
6,527,324 B2 3/2003 McManus et al.
6,536,823 B2 3/2003 McManus
6,619,713 B2 9/2003 Eichhorn
6,637,794 B2 10/2003 McManus et al.
6,708,454 B1 3/2004 Frerichs et al.
6,712,414 B2 * 3/2004 Morrow ..... 296/26.01
6,732,769 B2 * 5/2004 Del Campo ..... 141/97
6,772,563 B2 * 8/2004 Kuhn ..... 52/67
6,851,734 B2 2/2005 Findley
6,966,590 B1 11/2005 Ksiezopolki et al.
6,969,105 B2 11/2005 Rincoe
6,976,721 B2 12/2005 Rasmussen
6,981,728 B2 1/2006 Rasmussen
6,983,567 B2 1/2006 Ciotti
7,052,064 B2 5/2006 Rasmussen
7,052,065 B2 5/2006 Rasmussen
7,100,967 B2 9/2006 Shea
7,150,483 B2 12/2006 Rasmussen
7,234,747 B2 6/2007 Rasmussen
7,418,802 B2 * 9/2008 Sarine et al. ..... 52/79.5
7,712,813 B2 * 5/2010 Di Franco ..... 296/26.14
2001/0008059 A1 * 7/2001 McManus et al. ..... 52/67
2002/0116878 A1 8/2002 Ciotti
2002/0189173 A1 * 12/2002 Staschik ..... 52/79.1
2003/0115808 A1 6/2003 Morrow
2005/0072062 A1 * 4/2005 Aust et al. ..... 52/79.1
2005/0210762 A1 * 9/2005 Broberg ..... 52/79.1
2006/0201072 A1 * 9/2006 Gibson ..... 52/69
2007/0096505 A1 * 5/2007 Haack ..... 296/165
2007/0144078 A1 * 6/2007 Frondelius ..... 52/67
2007/0170740 A1 7/2007 Di Franco
2008/0134589 A1 * 6/2008 Abrams et al. ..... 52/79.1
2008/0256878 A1 * 10/2008 Berns et al. ..... 52/79.6

FOREIGN PATENT DOCUMENTS

JP 16084310 A 3/2004
KR 1020010089315 A 9/2001
KR 1020030008723 A 1/2003
WO WO 8401974 A1 * 5/1984

* cited by examiner

DEPLOYABLE PREFABRICATED STRUCTURE WITH AN EXTENSION STRUCTURE THAT IS SEALABLE TO THE PREFABRICATED STRUCTURE UPON DEPLOYMENT FROM THE PREFABRICATED STRUCTURE

CLAIM OF PRIORITY

This application claims benefit to the following U.S. Provisional Patent Application:

U.S. Provisional Patent Application No. 61/084,532, entitled "Deployable Prefabricated Structure," by James D. Pope, filed Jul. 29, 2008

CROSS-REFERENCE TO RELATED PATENT APPLICATIONS

This application incorporates by reference the following co-pending patent applications:

U.S. patent application Ser. No. 12/250,467, entitled "Deployable Prefabricated Structure with a Nested Extension Structure," by James D. Pope, filed Oct. 13, 2008.

U.S. patent application Ser. No. 12/250,468, entitled "Method of Deploying a Prefabricated Structure," by James D. Pope, filed Oct. 13, 2008.

U.S. patent application Ser. No. 12/250,469, entitled "System of Cooperating Prefabricated Structures," by James D. Pope, filed Oct. 13, 2008.

U.S. patent application Ser. No. 12/250,471, entitled "Method for Deploying Cooperating Prefabricated Structures," by James D. Pope, filed Oct. 13, 2008.

U.S. patent application Ser. No. 12/250,472, entitled "System and Method to Stabilize a Prefabricated Structure," by James D. Pope, filed Oct. 13, 2008.

U.S. patent application Ser. No. 12/250,482, entitled "Deployable Prefabricated Structure with an Extension Structure and a Deployable Floor," by James D. Pope, filed Oct. 13, 2008.

U.S. patent application Ser. No. 12/250,486, entitled "Deployable Prefabricated Structure with an Extension Structure and Interlocking Elements," by James D. Pope, filed Oct. 13, 2008.

U.S. patent application Ser. No. 12/250,491, entitled "Method of Deploying and Redeploying a Prefabricated Structure," by James D. Pope, filed Oct. 13, 2008.

U.S. patent application Ser. No. 12/250,493, entitled "System of Prefabricated Structures Arranged in a Complementary Layout," by James D. Pope, filed Oct. 13, 2008.

U.S. patent application Ser. No. 12/250,496, entitled "Method for Deploying Prefabricated Structures Arranged in a Complementary Layout," by James D. Pope, filed Oct. 13, 2008.

BACKGROUND

Recent catastrophic events, such as Hurricane Katrina and the Boxing Day Tsunami of 2004 have demonstrated a persisting need for prefabricated structures that can be easily and quickly deployed to disaster sites that do not necessarily have access to preexisting utilities and that can provide multiple logistical services to victims. Prefabricated structures suited for easy and quick deployment can further be used in other settings where preexisting utilities may not be present for temporary use such as at construction sites, or for more permanent use, such as at remote, undeveloped homestead.

DETAILED DESCRIPTION

Figure 1A:
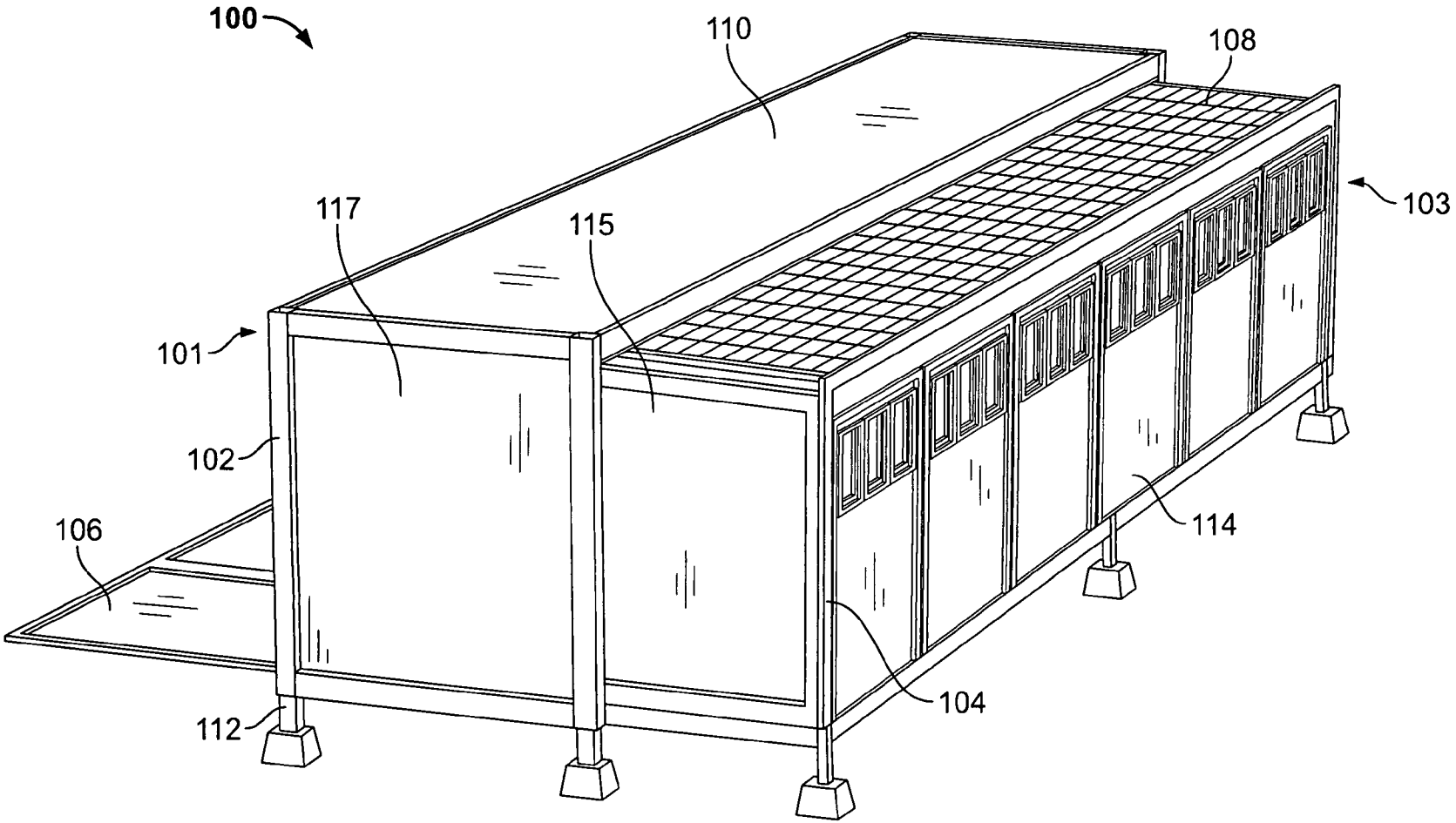
FIG. 1A is a rear-facing perspective view of an embodiment of a prefabricated structure in accordance with the present invention.

Common reference numerals are used throughout the drawings and detailed description to indicate like elements; therefore, reference numerals used in a drawing may or may not be referenced in the detailed description specific to such drawing if the associated element is described elsewhere.

Embodiments of a prefabricated structure and a system of cooperating prefabricated structures in accordance with the present invention can be quickly and efficiently anchored and deployed to reduce setup time, set up expense, and site preparation. Such embodiments can benefit structures intended for permanent use, emergency use such as for disaster relief, and/or for planned temporary use such as for classroom facilities and construction site administration.

Figure 1B:
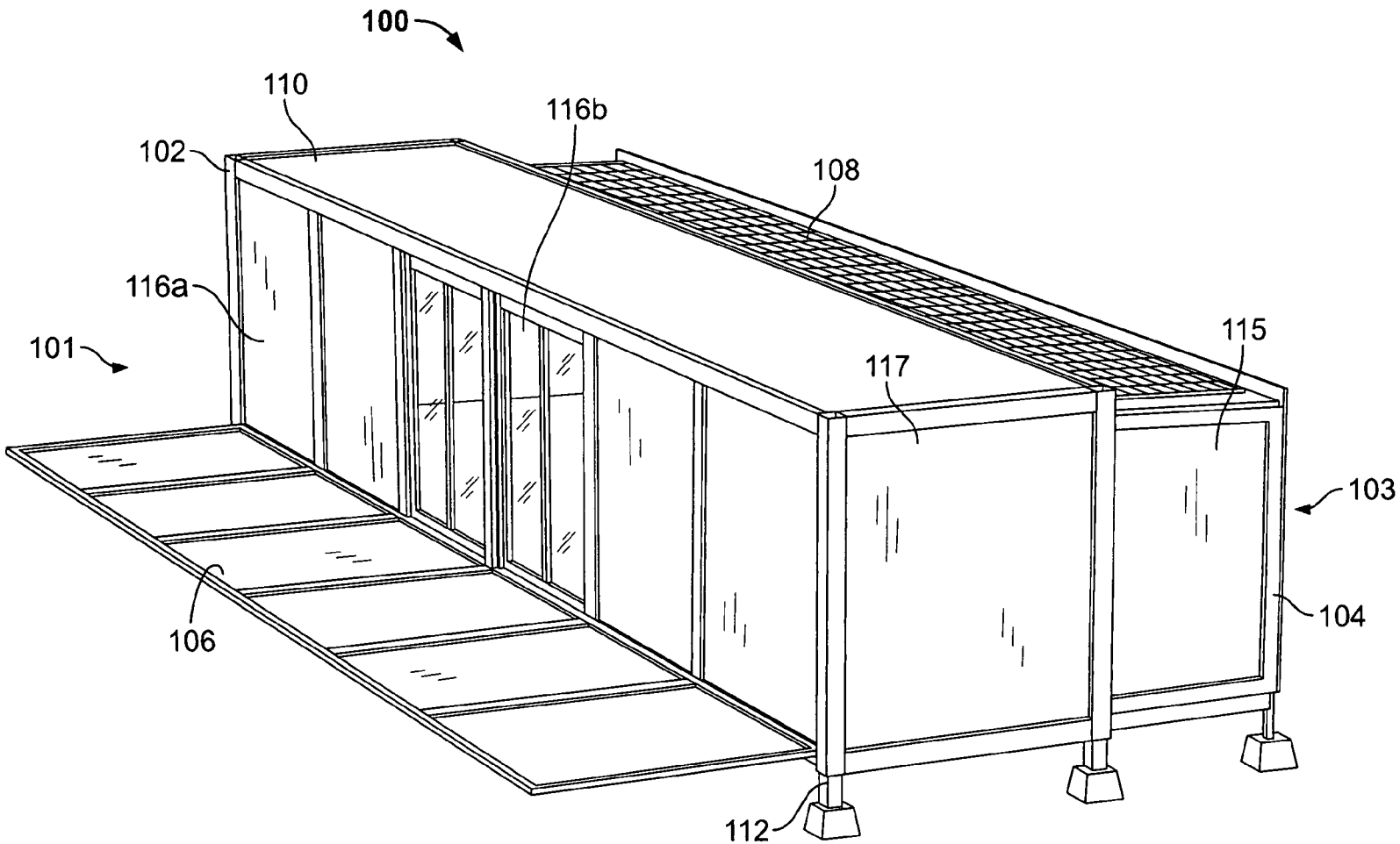
FIG. 1B is a front-facing perspective view of the prefabricated structure of FIG. 1B.

Referring to FIGS. 1A and 1B, an embodiment of a prefabricated structure 100 in accordance with the present invention is shown in a deployed arrangement. The prefabricated structure 100 includes a shell 101, an extension 103 deployed from the shell 101, and a deck 106 extending from an opposite side of the shell 101 from the extension 103. As shown, the prefabricated structure 100 is fixed in place by support posts 112 joined with a concrete base anchored by rebar driven into the ground. The support posts 112 can be adjusted vertically so that the prefabricated structure 100 can be leveled. Existing techniques for determining leveling can be applied to assist adjustment of the vertical deployment of the support posts 112 from the frames of the shell 101 and extension 103. As will be described below, the prefabricated structure 100 can be deployed in stages so that the support posts 112 can be extended and fixed in a systematic fashion.

The prefabricated structure 100 can be substantially self-contained, in that it need not be connected to preexisting electrical grids, water and/or sewage service lines. The prefabricated structure 100 includes a service pack comprising one or more batteries (shown below) providing electrical power for lighting and appliances, as well as for electrical tools and gadgets accessorizing the living space. The one or more batteries are recharged by a solar panel 108 connected with a roof of the extension 103. The service pack further comprises a generator for providing electrical power to the prefabricated structure 100 and/or supplementally recharging the one or more batteries. The generator can be driven by propane, or some other liquid or gas fuel.

Panels 114, 115, 117 can be mated with the shell frame 102 and extension frame 104 to provide exterior walls and to seal the prefabricated structure 100 from moisture and suppress undesirable heat exchange with the environment. Panels can be selected based on the function or configuration of structures within the prefabricated structure 100. For example, the prefabricated structure of FIGS. 1A and 1B can include panels 114 connected with the extension frame 104 having windows to pass natural light into the extension 103. Two different types of panels 116*a,b* are connected to the shell frame 102 along the length of the shell 101 to provide a wall (116*a*) and an entryway (116*b*). In other embodiments, some other combination and shape of panel can be used. For example window panels can substitute for solid panels.

Figure 1C:
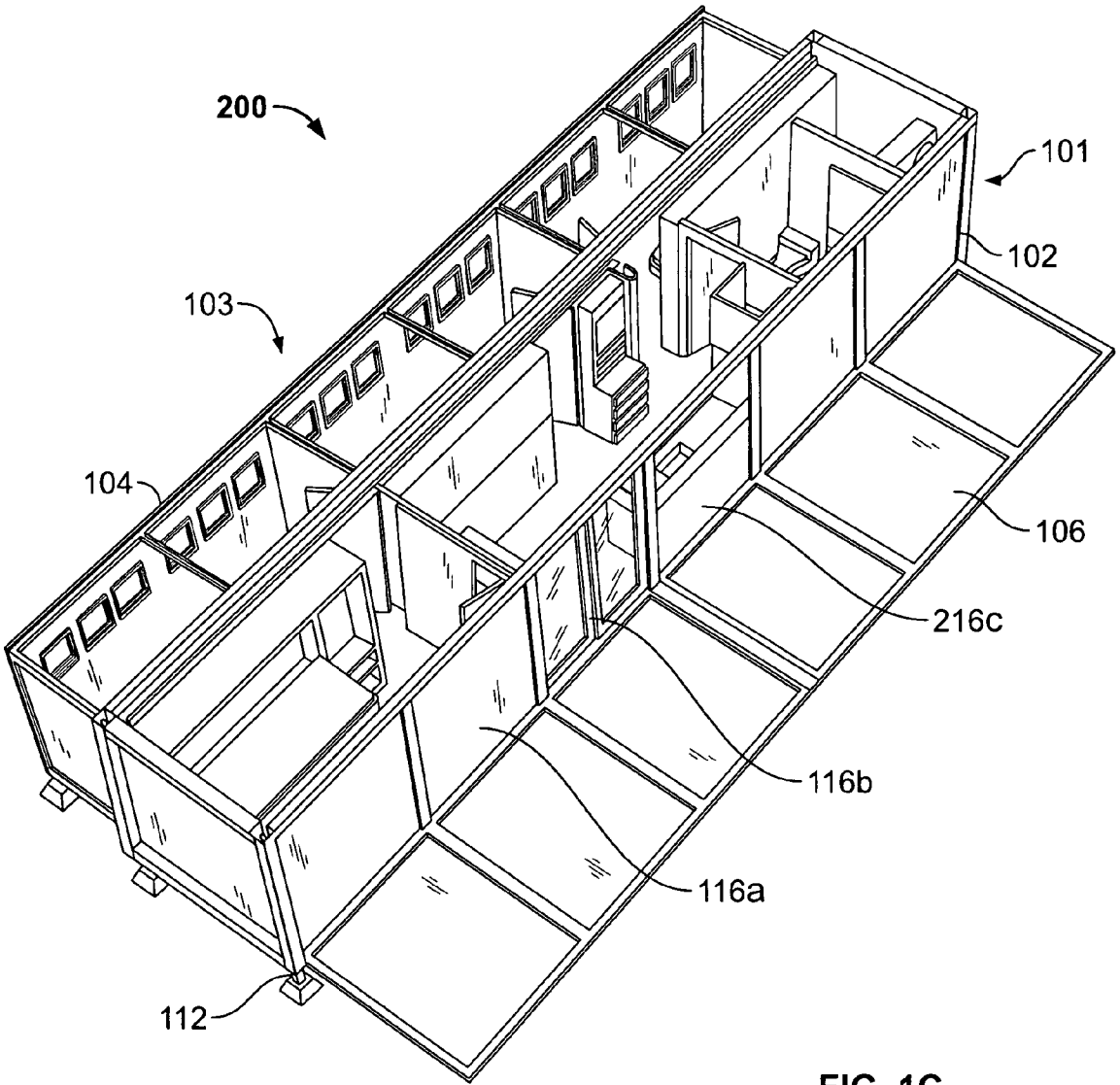
FIG. 1C is a top-down perspective view of an alternative embodiment of a prefabricated structure in accordance with the present invention.
Figure 1D:
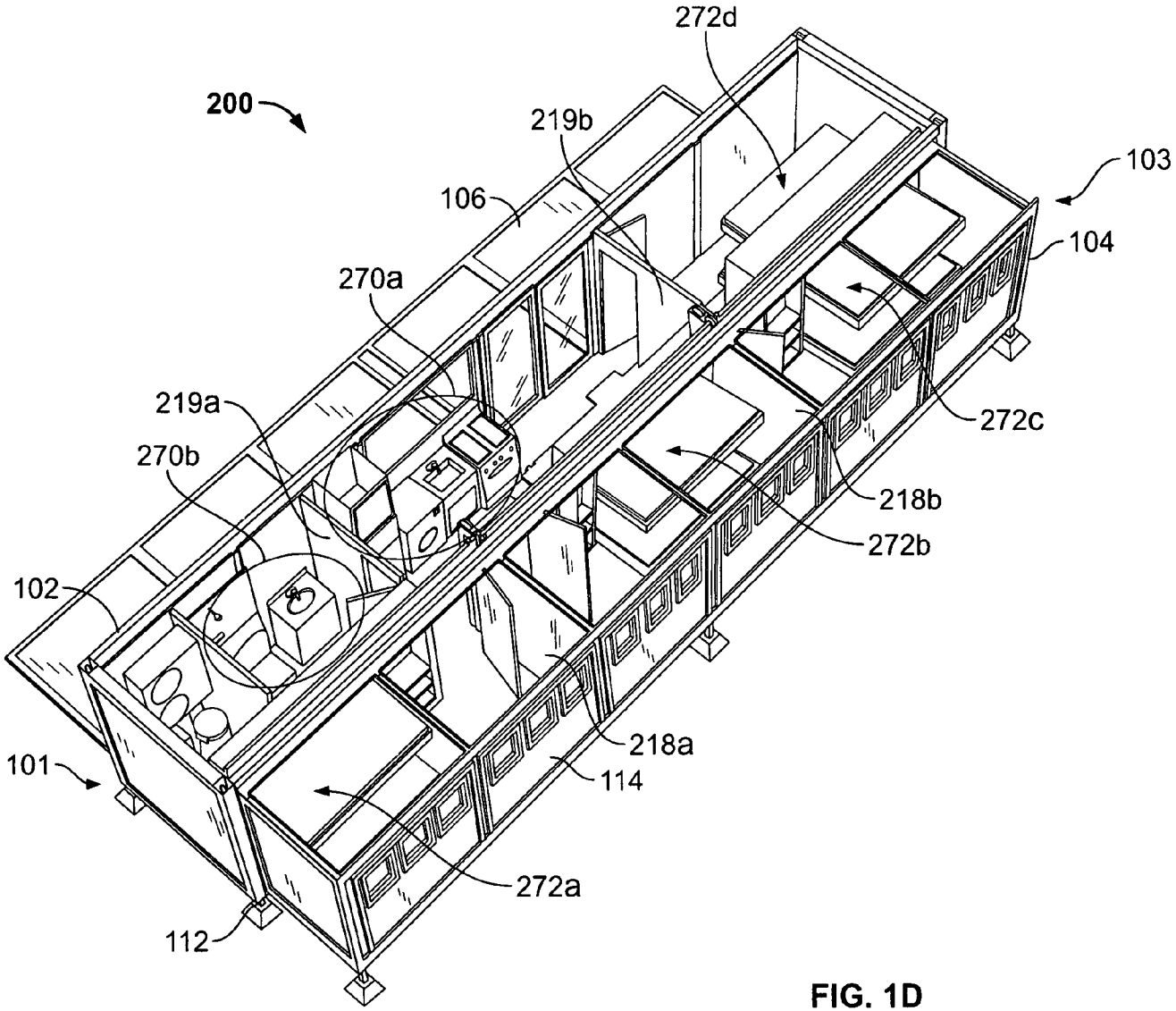
FIG. 1D is a top-down perspective view of a still further embodiment of a prefabricated structure in accordance with the present invention.

Referring to FIGS. 1C and 1D an alternative embodiment of a prefabricated structure 200 in accordance with the present invention differs from the embodiment of FIGS. 1A and 1B in that panels having three different configurations 116*a-c* are connected along the length of the shell frame 102. A panel 216*c* including a window is connected with the shell frame 102 and positioned adjacent to a panel 116*b* providing an entrance to the prefabricated structure 200. Use of panels connected between support structures of the frames 102,104 allows a prefabricated structure in accordance with the present invention to be adapted to intended use and/or customized to individual taste. Use of panels may further require only partial replacement when the prefabricated structure is damaged by severe weather, for example, or vandalism, or refurbished for reuse.

The roofs of the extension 203 and shell 201 of the prefabricated structure 200 of FIGS. 1C and 1D are removed to illustrate furniture and appliances that can be installed within the prefabricated structure 200 prior to delivery to a site. The shell 201 comprises a kitchen having kitchen appliances 270*a*, and a bathroom having bathroom fixtures 270*b* separated from the kitchen by a wall 219*a*. As shown, the shell 201 further comprises sleeping quarters separated from the entrance by a wall 219*b* and having a pair of bunks 272*d*. The extension 203 includes sleeping quarters separated into three rooms each of which includes a pair of bunks 272*a-c*. The bunks are pivotably connected with a fixed wall or structure separating the shell 201 from the extension 203, and pivot down into place upon deployment of the extension 203. Walls 218*a,b* separating the rooms of the extension 203 are positioned across the shell 201 when the extension 203 is nested within the shell 201, and are drawn out when the extension 203 is deployed. The walls 218*a,b* can be received in the shell 201 so that the walls 218*a,b* fill unoccupied space. For example, a wall 218*a* can be received in a space provided between appliances 270*a* of the kitchen. The prefabricated structure 200 as shown is intended to provide shelter for eight occupants.

Figure 1E:
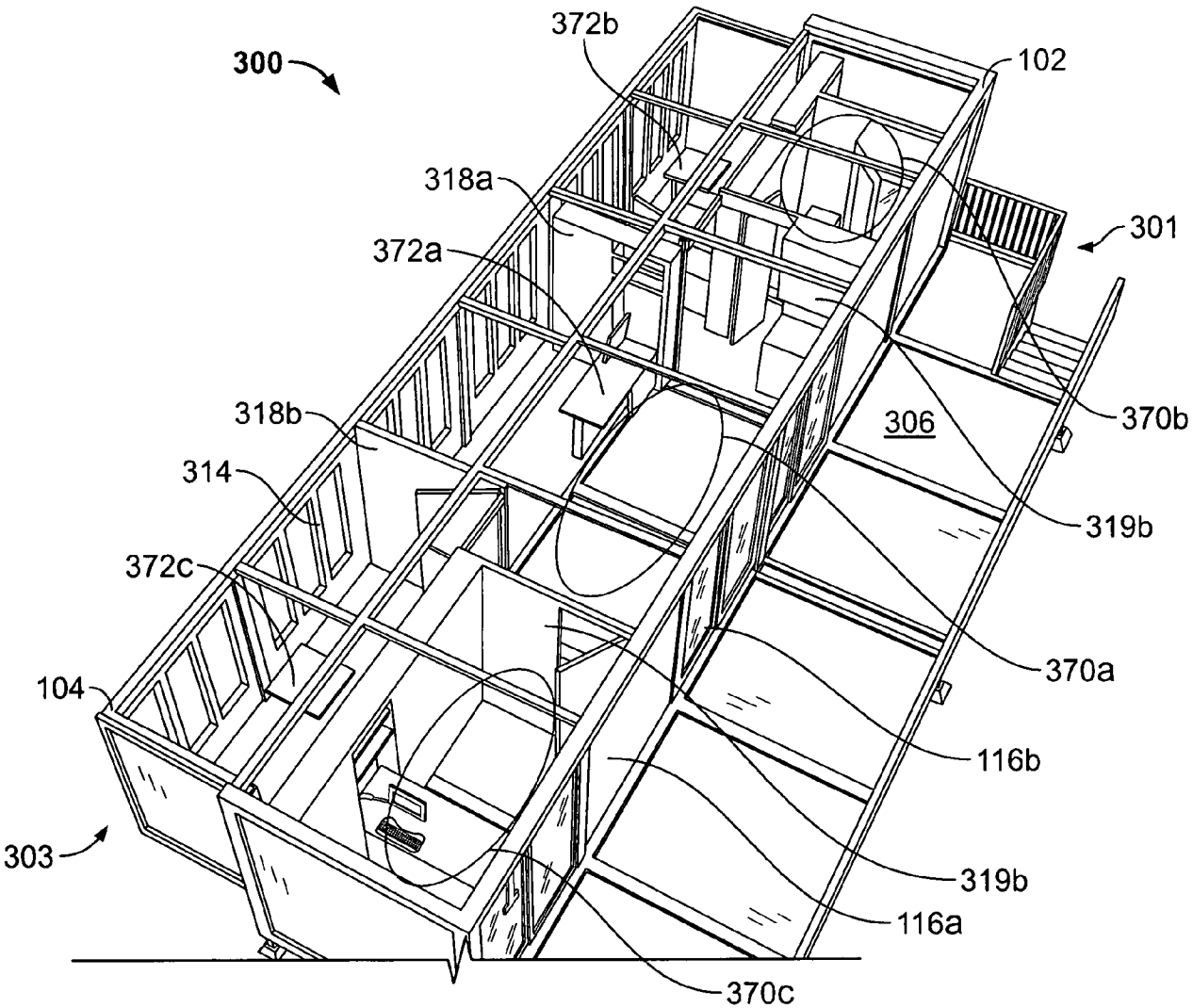
FIG. 1E is a top-down perspective view of a further embodiment of a prefabricated structure in accordance with the present invention.

Referring to FIG. 1E a further embodiment of a prefabricated structure 300 in accordance with the present invention configured for use as an administrative unit is shown. The shell 301 of the prefabricated structure 300 includes panels having two different configurations 116*a,b* connected along the length of the shell frame 102. Further, the extension 303 of the prefabricated structure 300 includes panels 314 connected along the length of the extension frame 104 having windows that extend lower than windows of previously described embodiments. The shell 301 comprises a receiving area 370*a*, a bathroom having bathroom fixtures 370*b* separated from the receiving area 370*a* by a wall 319*a*. The shell 301 further comprises an office 370*c* separated from the receiving area 370*a* by a wall 319*b* and having a desk that pivots down from a collapsed position upon deployment of the prefabricated structure 300. The extension 303 includes a reception desk 372*a* that pivots down from a collapsed position within a wall 318*a*. The reception desk 372*a* separates two offices 372*b,c* of the extension 303 and the two offices 372*b,c* are accessed by way of the receiving area 370*a*. Each office 372*b,c* includes a desk that pivots down from a collapsed position upon deployment of the extension 303 from the shell 301. As above, walls 318*a,b* separating the offices 372*b,c* of the extension 103 are positioned across the shell 301 when the extension 303 is nested within the shell 301, and are drawn out when the extension 303 is deployed. The walls 318*a,b* can received in the shell 301 so that the walls 318*a,b* fill unoccupied space. The prefabricated structure 300 as shown can serve as a stand-alone administration building, for example at a construction site, or can be associated with a plurality of other units, for example, the prefabricated structure 300 can be connected with a cluster of cooperating units and serve as the administration unit for the cluster of cooperating units.

Figure 1F:
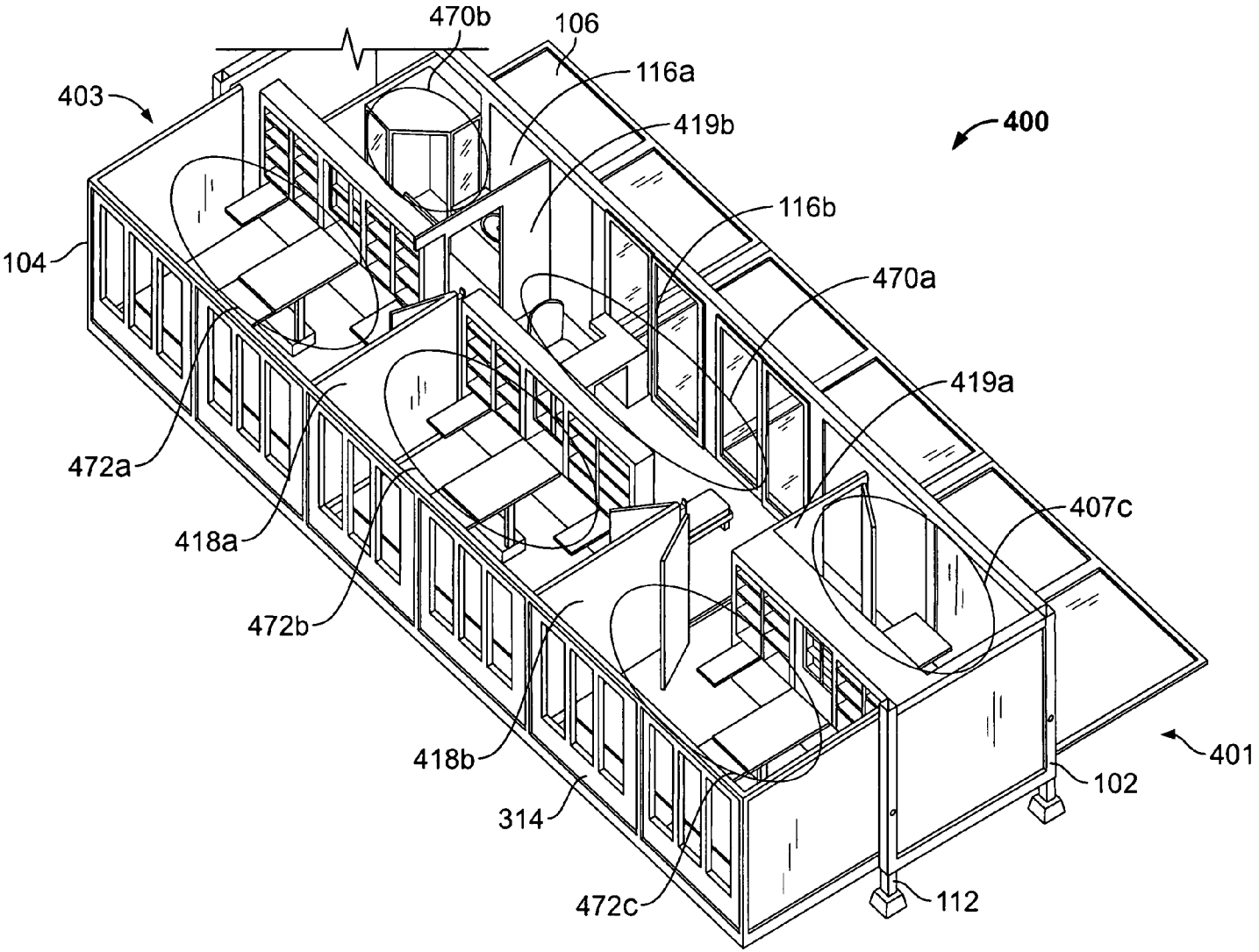
FIG. 1F is a top-down perspective view of a further embodiment of a prefabricated structure in accordance with the present invention.

Referring to FIG. 1F a still further embodiment of a prefabricated structure 400 in accordance with the present invention configured for use as a medical unit is shown. The shell 401 of the prefabricated structure 400 includes panels having two different configurations 116*a,b* connected along the length of the shell frame 102. Further, the extension 403 of the prefabricated structure 400 includes panels 314 connected along the length of the extension frame 104 having windows that extend low. The shell 401 comprises a reception area 470*a*, a bathroom having bathroom fixtures 470*b* separated from the reception area 470*a* by a wall 419*a*. The reception area includes a reception desk and seating. The shell 401 further comprises an examination room 470*c* separated from the reception area 470*a* by a wall 419*b* and having an examination table that pivots down from a collapsed position upon deployment of the extension 403. The extension 403 includes three examination rooms 472*a-c* including an examination table that pivots down from a collapsed position and a pair of additional tables for holding instruments, charts, etc. that pivot down from a collapsed position upon deployment of the extension 403 from the shell 401. As above, walls 418*a,b* separating the examination rooms 472*a-c* of the extension 403 are positioned across the shell 401 when the extension 403 is nested within the shell 401, and are drawn out when the extension 403 is deployed. The walls 418*a,b* can received in the shell 401 so that the walls 418*a,b* fill unoccupied space.

Figure 2A:
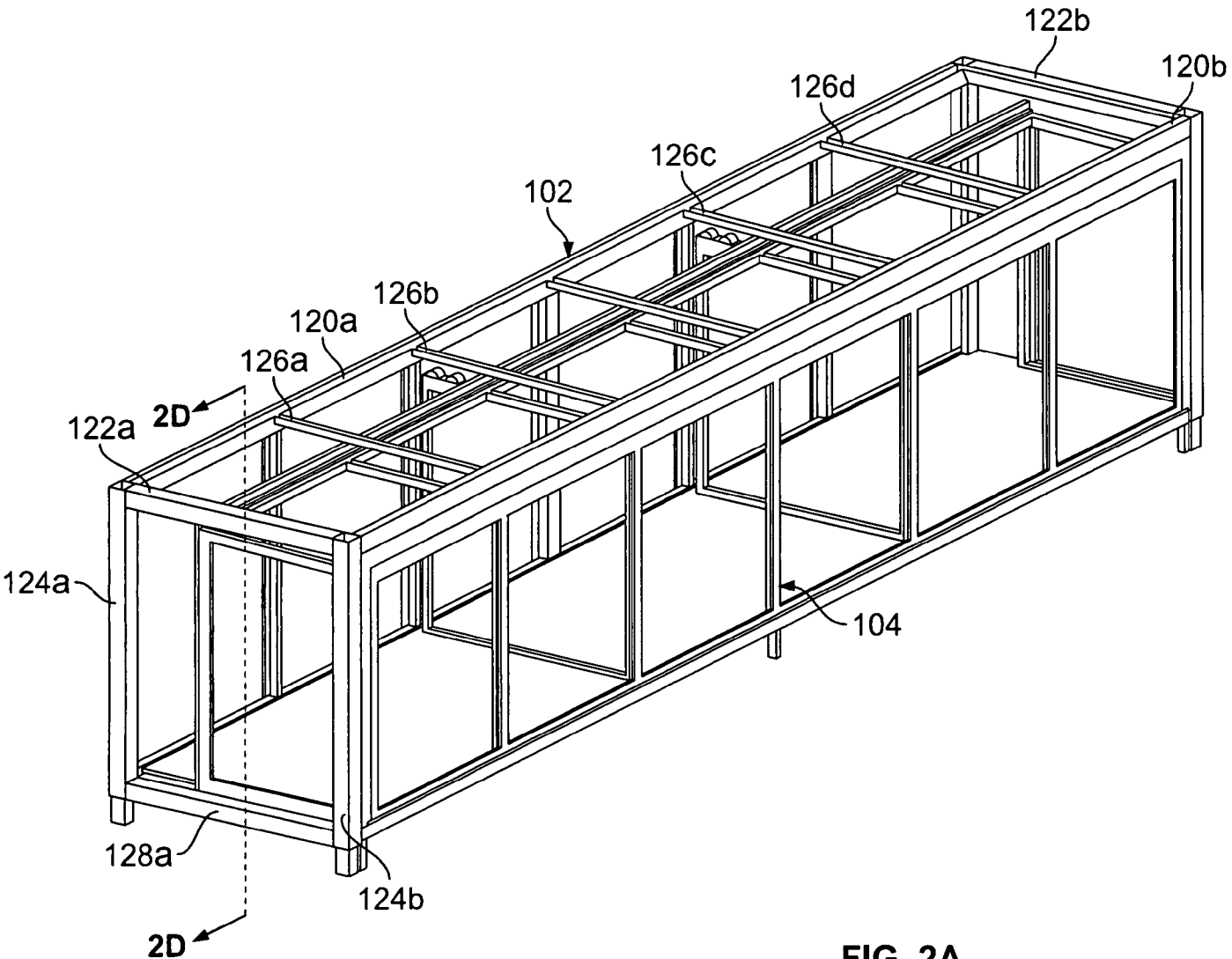
FIG. 2A is a perspective view of a shell frame and an extension frame nested within the shell frame of the prefabricated structure of FIG. 1A.

The embodiments of prefabricated structures shown in FIGS. 1A-1F comprise substantially the same frame structure. Referring to FIG. 2A, the frame structure is shown without panels or furniture, and comprises the extension frame 104 nested within the shell frame 102. A floor support of the extension frame 104 telescopingly engages a floor support of the shell frame 102 and a floor of the extension 103 can be deployed in roughly the same plane as the floor of the shell 101. The roof support of the extension frame 104 is positioned at a height shorter than a height of the shell frame 102.

Figure 2B:
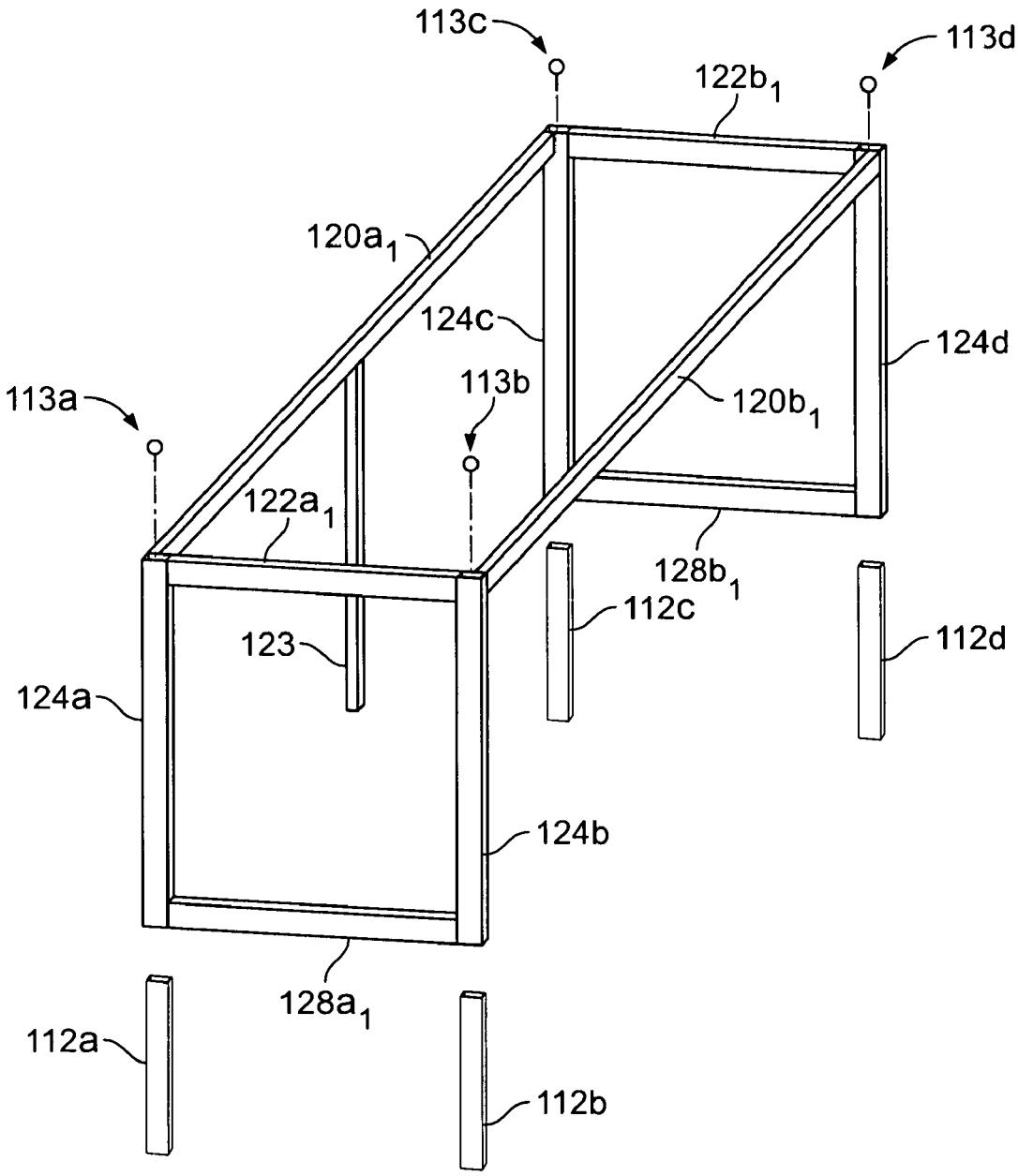
FIG. 2B is a perspective view of a roof support of the shell frame of FIG. 2A.
Figure 2C:
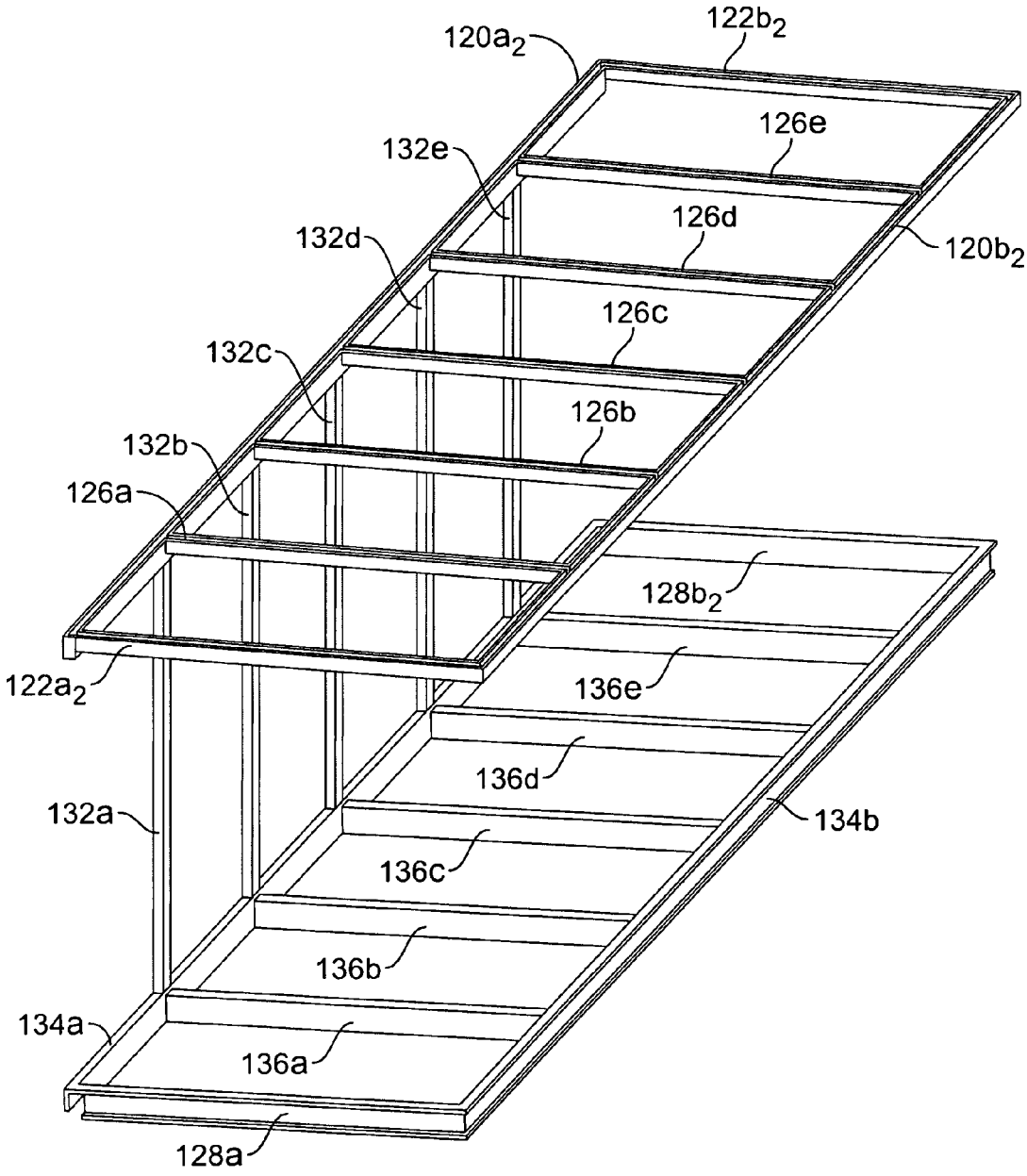
FIG. 2C is a perspective view of a floor support of the shell frame of FIG. 2A.
Figure 2D:
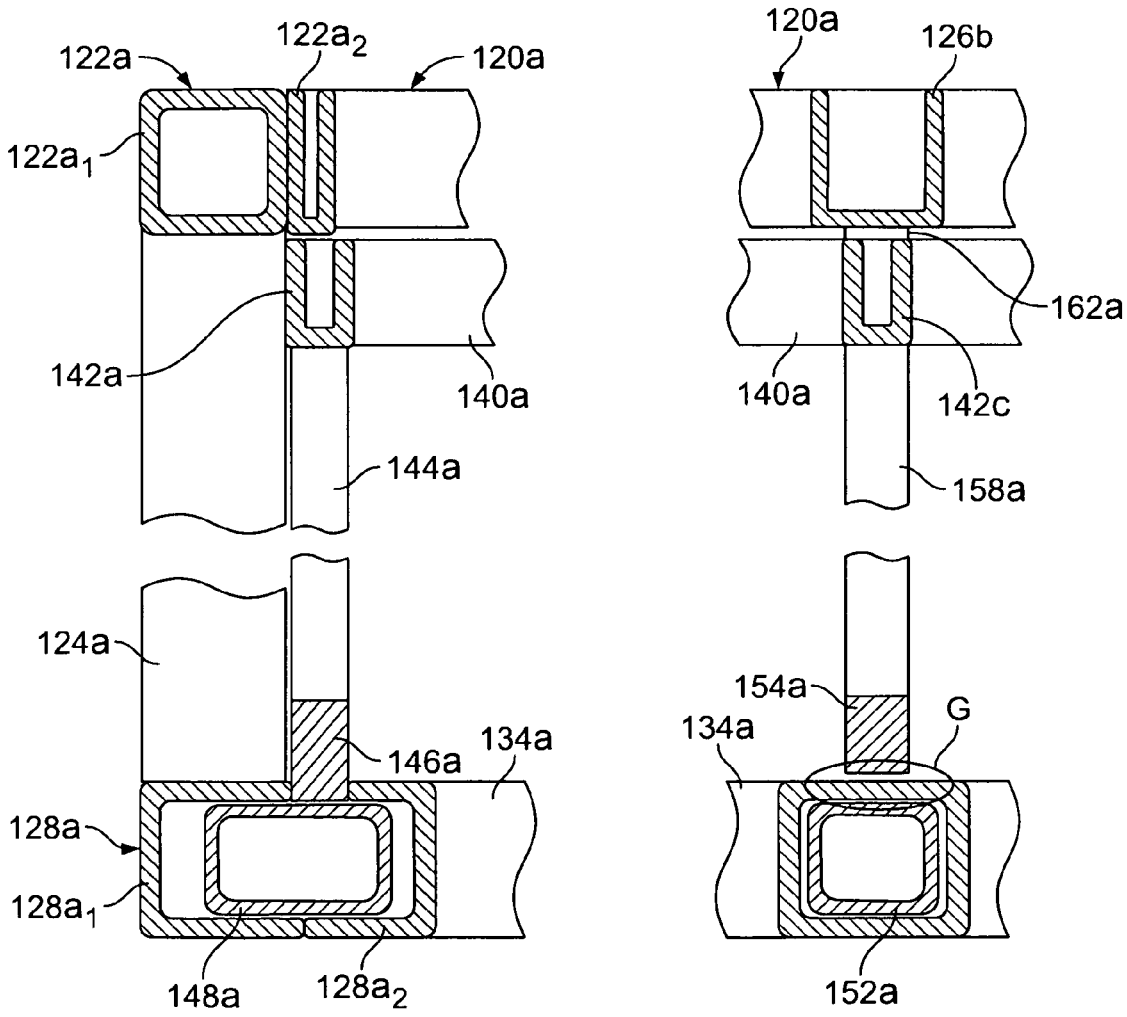
FIG. 2D is a cross-section of a portion of the extension frame and shell frame showing the relationship of telescoping members.

Referring to FIGS. 2B and 2C, the shell frame 102 is shown in two portions. An inner portion is shown in FIG. 2B comprising a first pair of roof beams 120*a*1,*b*1 extending lengthwise along the shell and a second pair of roof beams 122*a*1,*b*1 extending between and transverse to the first pair of roof beams 120*a*1,*b*1. The roof beams 122*a*1,*b*1 are connected with corresponding floor beams 128*a*1,*b*1 of the floor by vertical structures 124*a-d* (vertical structures that provide primary resistance to compressive forces are hereinafter referred to as columns). The columns 124*a-d* include cavities extending through at least a portion of the columns 124*a-d* to house support posts 112*a-d* extendable from the bottoms of the columns 124*a-d* and eye hooks 113*a-d* detachably received in a cavity in the tops of the columns 124*a-d*. The eye hooks can enable positioning of the prefabricated structures through use of a crane or helicopter, for example. An additional vertical support 123 extends down from a roof beam 120*a*1. An outer portion of the shell frame 102 is shown in FIG. 2C comprising a pair of floor beams 134*a,b* extending lengthwise along the shell and a pair of beams 128*a*2,*b*2 having a J-shaped cross-section (seen more clearly in FIG. 2D) fixedly connecting with the floor beams 128*a*1,*b*1 of the outer portion to define a slotted beam 128*a,b* extending between and transverse to the pair of floor beams 134*a,b* of the inner portion. FIG. 2D is a partial cross-section of the extension frame 104 received within the shell frame 102, illustrating the relationship between the outer portion and inner portion of the shell frame 102 and between the shell frame 102 and the extension frame 104. As shown, the outer portion of the shell frame 102 is fixedly connected with the inner portion of the shell frame 102 so that a slotted beam 128*a* is formed that receives a floor beam 148*a* of the extension frame 104 in a telescoping fashion, while passing a wall base 146*a* and vertical structures 144*a* of the extension frame 104. The inner portion comprises a pair of inner roof joists 122*a*2,*b*2 connected with or integrally formed with the second pair of roof beams 122*a*1,*b*1 of the outer portion and a plurality of roof joists 126*a-e* extending between and transverse to the first pair of roof beams 122*a*2,*b*2. The inner portion further comprises a plurality of floor joists 136*a-e* extending between and transverse to the floor beams 134*a,b* and spaced along the shell frame between the pair of slotted beams 128*a,b* and a series of vertical structures 132*a-e* extending between a floor beam 134*a* and a roof beam 120*a*. In an embodiment, the vertical structures 132*a-e* can be C-channels, as explained in more detail below.

In a preferred embodiment the outer portion is fabricated from aluminum or an aluminum alloy and the inner portion is fabricated from steel or a steel alloy. The components of the inner portion and the outer portion can be welded, riveted, bonded or otherwise fixedly connected. In other embodiments, the inner portion and outer portion can be fabricated from the same material. Further, the slotted beam 128*a,b* can comprise the floor beams 128*a*2,*b*2 of the inner portion welded to a separate pair of beams 128*a*1,*b*2, or alternatively, the slotted beam can be fabricated from a single piece of material of a single composition. One of ordinary skill in the art in view of the teachings contained herein will appreciate the myriad different techniques for fixedly connecting the components of the shell frame, and the various tradeoffs in strength and weight for using different materials in fabricating the shell frame.

Figure 2E:
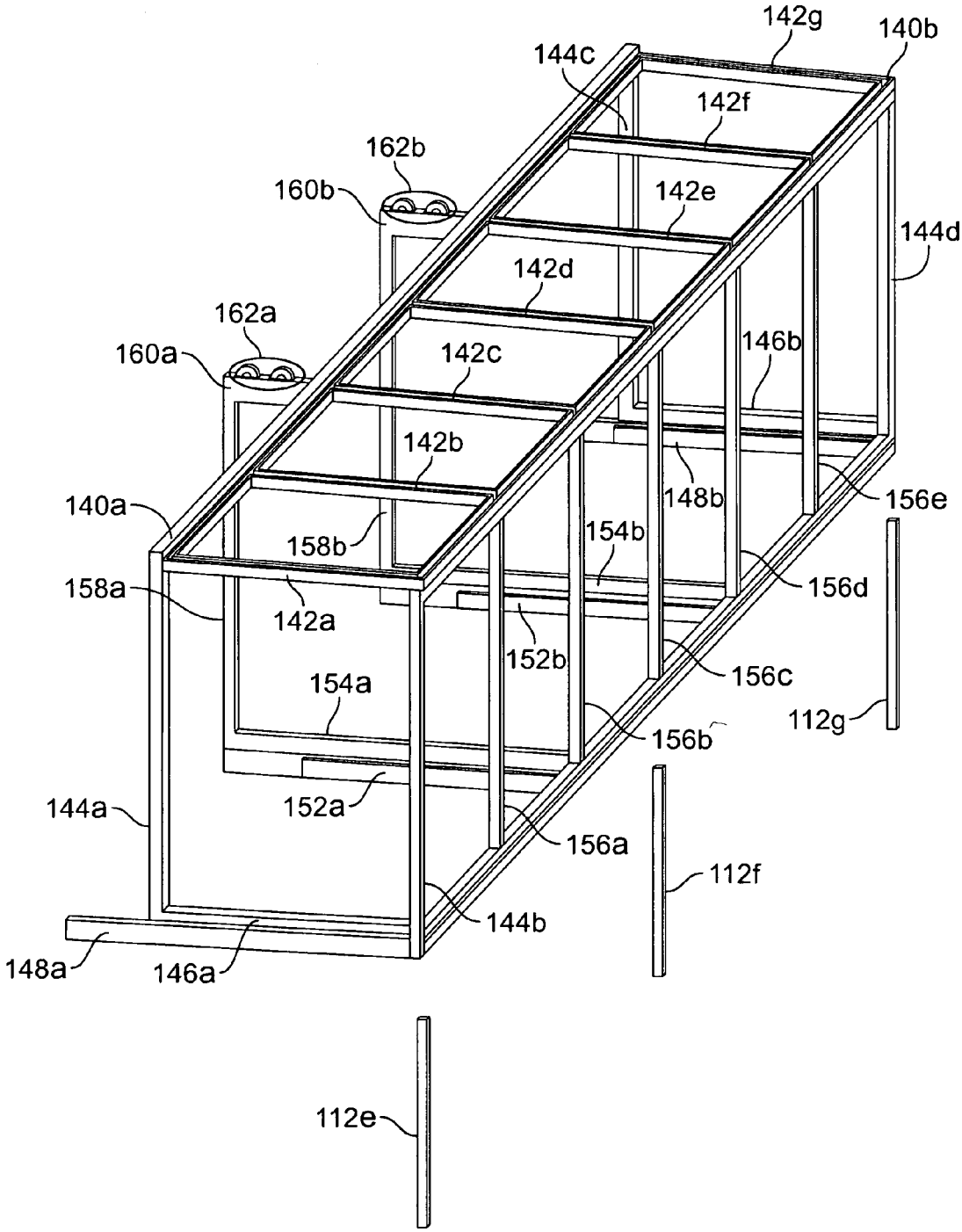
FIG. 2E is a perspective view of the extension frame of FIG. 2A.

Referring to FIG. 2E, the extension frame 104 is shown. The extension frame 104 comprises an extension roof support and an extension floor support. The extension floor support includes a main floor beam 150 extending lengthwise, a pair of extension floor beams 148*a,b* extending from the main floor beam 150 and telescoping from the respective slotted beams 128*a,b* of the shell frame 102, and a pair of extension joists 152*a,b* extending from the main floor beam 150 and telescoping from corresponding floor joists 136*b,d* of the shell frame 102. The extension roof support includes a pair of roof beams 140*a,b* extending lengthwise along the shell and seven roof joists 142*a-g* extending between and transverse to the pair of roof beams 140*a,b*. The roof beams 140*a,b* are connected with the floor beams 148*a,b* by columns 144*a-d*. The columns 144*a-d* include cavities extending through at least a portion of the columns 144*a-d* to house support posts 112*e-g* extendable from the bottoms of the columns 144*a-d*. A series of vertical structures 156*a-e* extend between the floor beam 150 and a roof beam 140*b*. In an embodiment, the vertical structures 156*a-e* can be C-channels, as explained in more detail below. Two of the vertical structures 156*b,d* support walls of the extension 104 and are connected to corresponding wall bases 154*a,b*. Each wall base 154*a,b* is connected to an additional vertical wall support 158*a,b*. The vertical wall supports 158*a,b* are connected with the roof beam 140*a* by a ledge 160*a,b*. The vertical structure 156*b,d*, the wall base 154*a,b*, and the vertical wall support 160*a,b* together support a wall dividing sections of the extension 103. The wall protrudes past the roof beam 140*a* of the extension to provide the ledge 160*a,b*, which can apply a force to a complementary joist 126*b,d* of the shell roof to assist in maintaining the cantilever extension approximately horizontal during deployment. As shown, a pair of spring biased rollers 162*a,b* extend from each ledge 160*a,b*. The rollers 162*a,b* are biased toward the complementary joist 126*b,d* to apply force to at least partially counterbalance the moment force along the portion of the extension telescoped from the shell frame 102 while rolling to reduce impeding deployment of the extension 103 from the shell 101. As can be seen more clearly in FIG. 2D, the wall base 154*a,b* is separated from the floor joist 152*a,b* by some small gap G so that the wall base 154*a,b* passes over the floor joist 134*a* of the shell frame 102 in a sliding, or separated fashion.

Figure 3B:
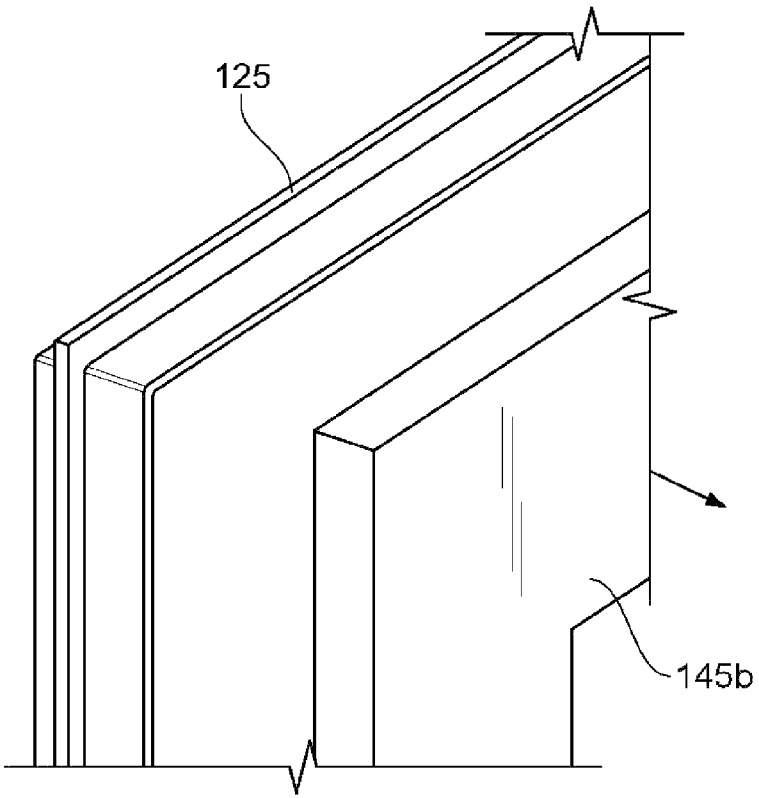
FIGS. 3A-3F are perspective blow-up views of a portion of a double seal system to seal the prefabricated structure when the extension is in a deployed position and an undeployed position.
Figure 3A:
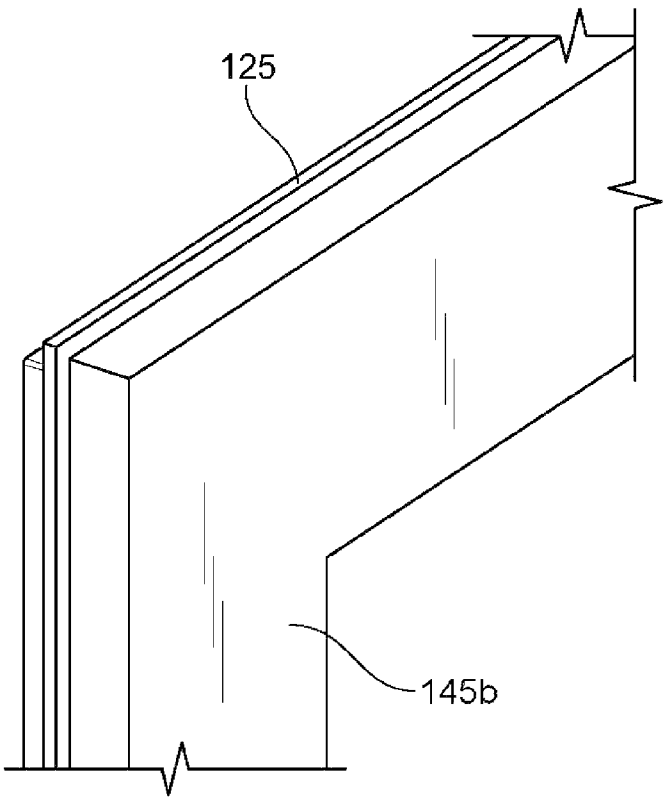
Figure 3D:
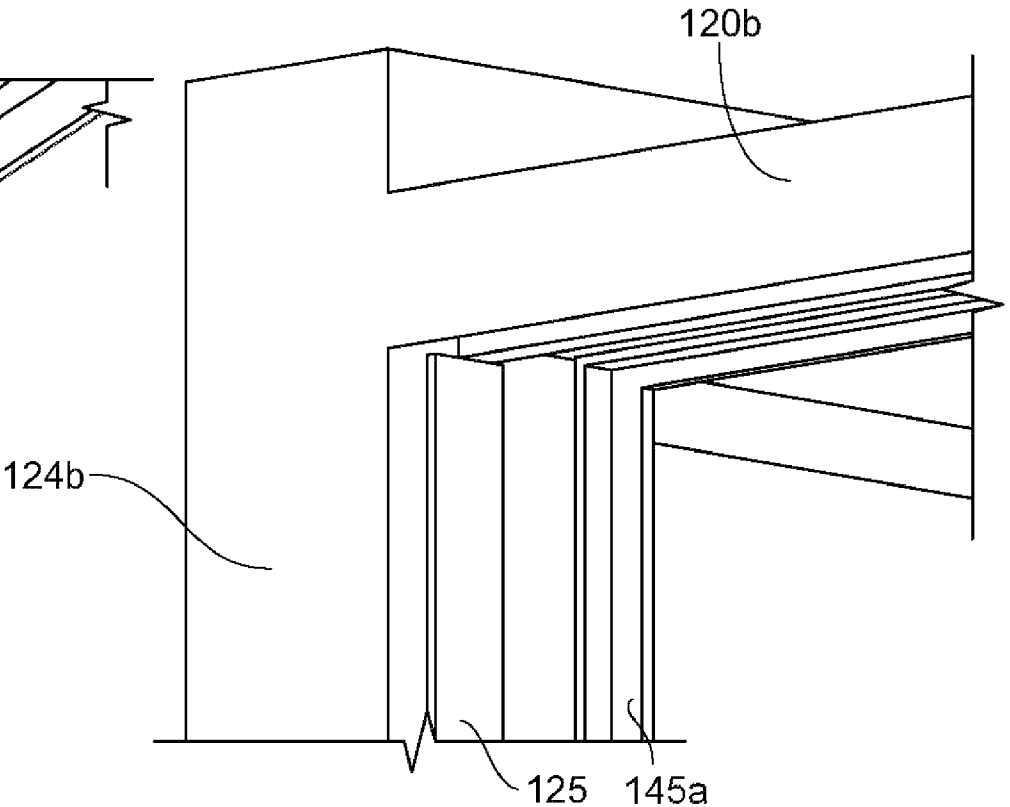
Figure 3C:
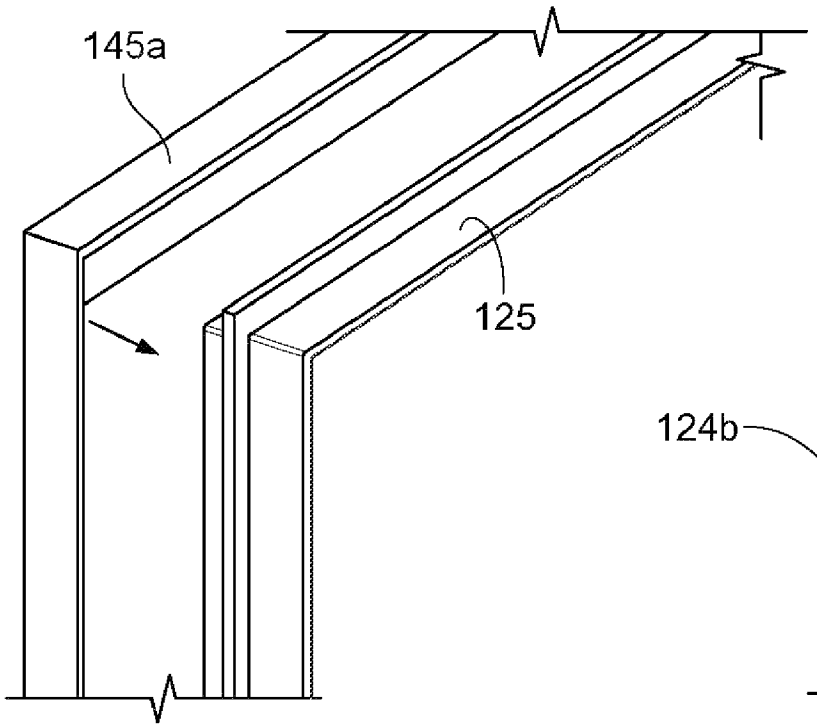
Figure 3F:
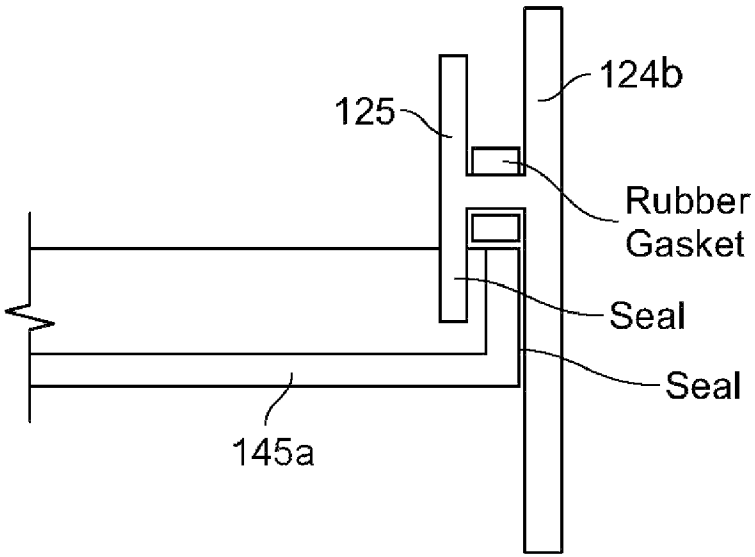
Figure 3E:
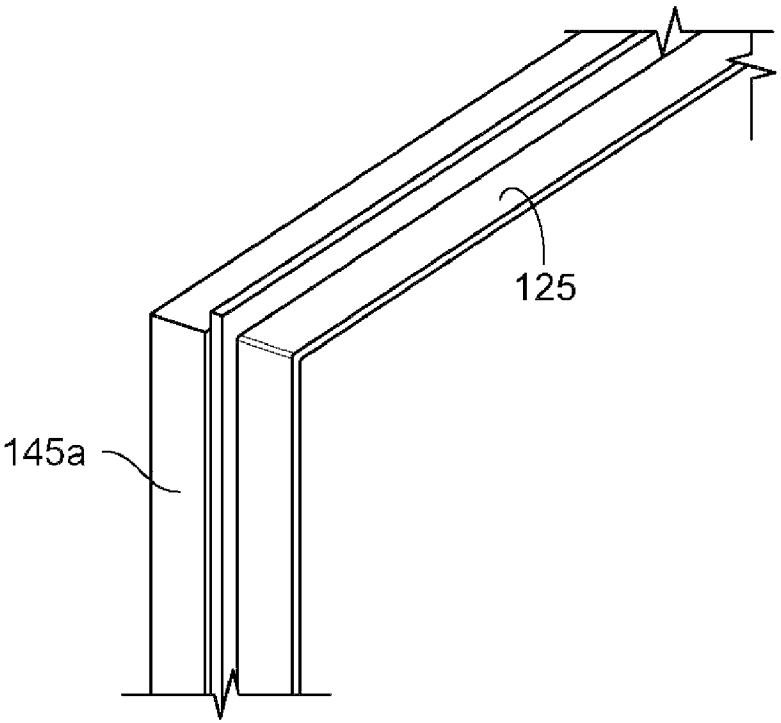

It can be desirable to seal the prefabricated structure from environmental elements at least in a deployed configuration, and preferably in both a deployed configuration and a nested configuration. In a preferred embodiment of a prefabricated structure in accordance with the present invention, a T-flange can extend from structures along the perimeter of the extension. The T-shaped flange can extend inward from the extension-side columns 124*b,d* and the extension-side roof beam 120*b*. Referring to FIGS. 3A-3D and 3F, the t-shaped flange 125 is shown separate from the extension-side column 124*b* and extension-side roof beam 120*b* to more clearly explain the relationship between the extension and the T-shaped flange 125. The T-shaped flange 125 provides pockets to receive and form seals with complementary inner and outer lips associated with the extension. In the embodiment shown, the inner and outer lips are defined by a pair of trim pieces connected along the at least three edges of the extension, including the extension columns 144*a-d* and the roof beams 140*a,b*. A trim piece can have, for example, an L-shape that complements one half of the T-shaped flange 125. The trim pieces complement separate halves of the T-shaped flange 125. Referring to FIG. 3A, the extension is shown in a closed position with a trim piece 145*b* mating with the T-shaped flange 125. As the extension 103 deploys, the trim piece 145*b* decouples from the T-shaped flange, as shown in FIG. 3B. As the extension reaches full deployment, the trim piece 145*a* at an opposite end of the extension approaches the T-shaped flange 125, as shown in FIG. 3C, which shows the T-shaped flange 125 connected with and extending from the extension-side column 124*b*. The trim piece 145*a* mates with the T-shaped flange as the extension 103 reaches full deployment, as shown in FIG. 3E and FIG. 3F. Referring to FIG. 3F, rubber gaskets are fixedly connected with one or both of the T-shaped flange 125 and the trim piece 145*a* so that when the structures are mated, a seal is formed, to suppress penetration of water and/or air at the flange.

Figure 4A:
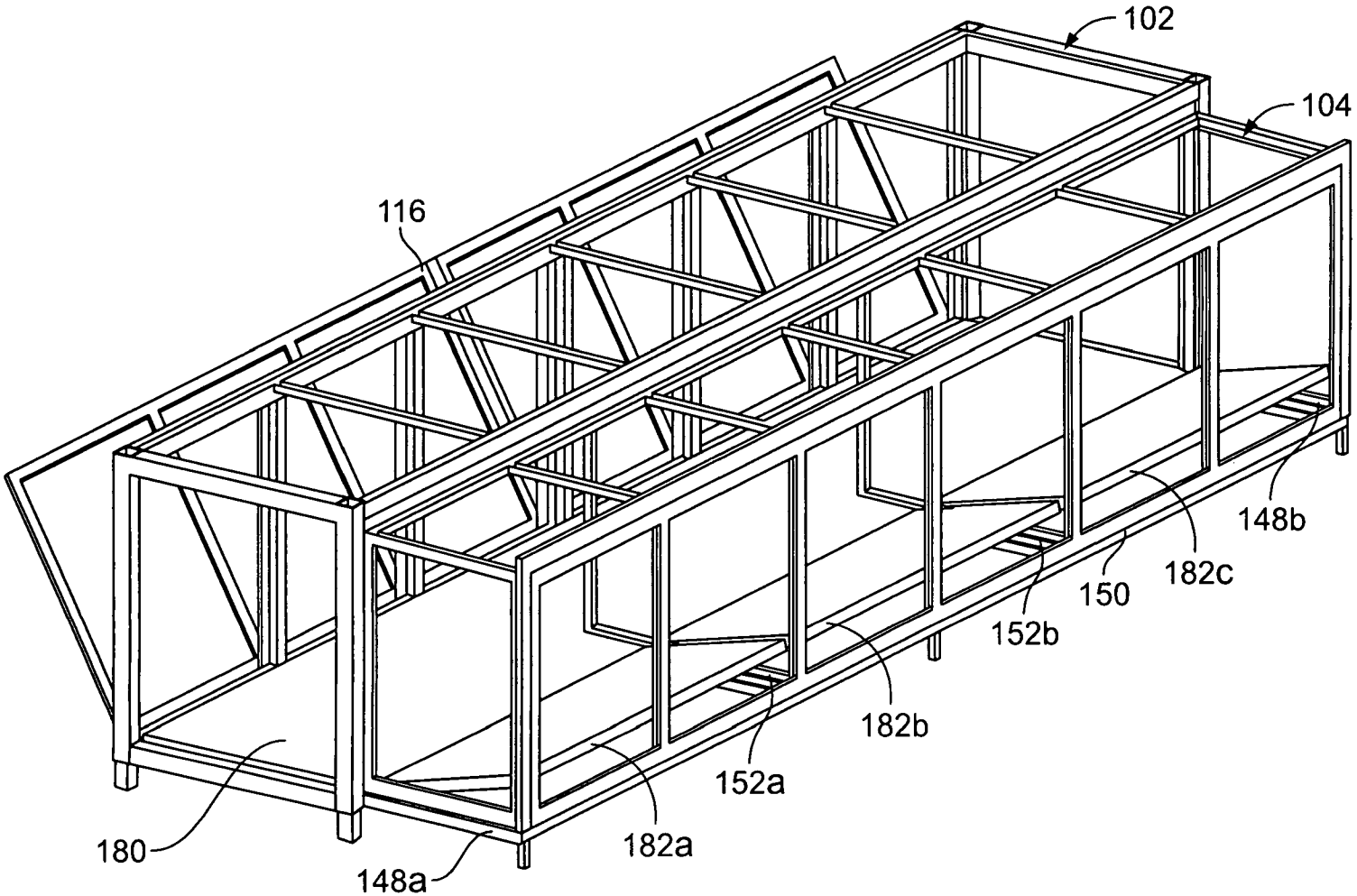
FIG. 4A is a perspective view of the pre-fabricated structure showing the hinged connection of the deck and the extension floor.
Figure 4C:
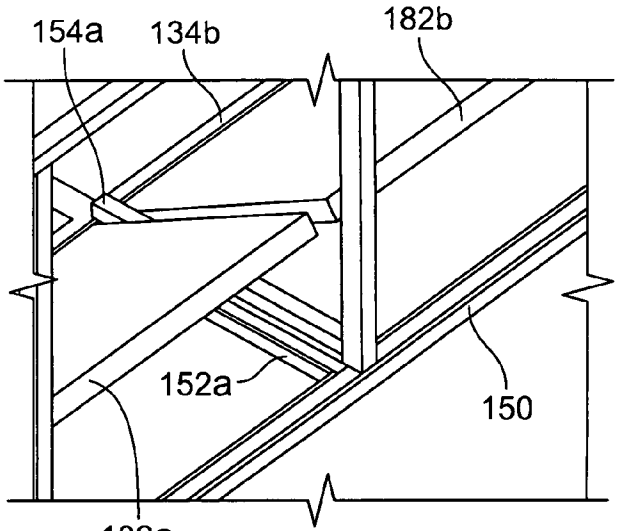
FIGS. 4B-4D are perspective views of the extension floor in progressive stages of deployment.
Figure 4B:
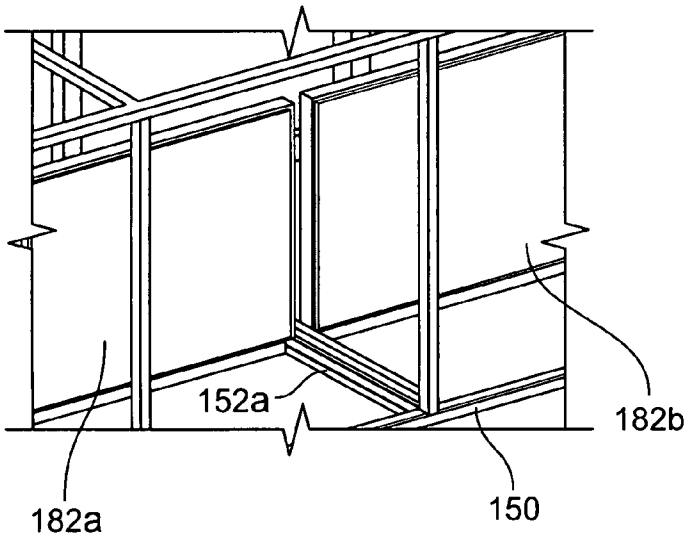
Figure 4D:
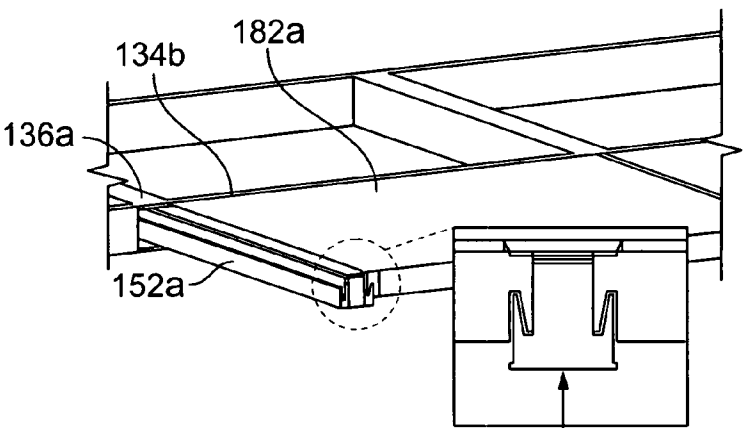

Referring to FIGS. 4A-4D, floor panels 182*a*-182*c* of the extension 103 pivot from a collapsed, upright position to a flat, seated position upon deployment of the extension frame 104. The floor panels 182*a*-182*c* are pivotably connected with one or both of the shell frame 102 and the shell floor 180 and in a collapsed position are arranged vertically so that the weight of the floor panels 182*a*-182*c* is applied to the wall of the extension 103. Referring to FIGS. 4B-4D, as the extension frame 103 deploys, the floor panels slide down the wall of the extension 104 moving from the deployed position of FIG. 4B to the partially deployed position of FIG. 4C, to the fully deployed position of FIG. 4D. As can be seen in FIG. 4D, the telescoping floor joists 152*a* of the extension frame 103, include a lock feature that extends laterally from the floor joist 152*a* and that receives a complementary lock feature of the floor panel 182*a*. The lock features enables the floor panel 182*a* to lock into position so that a surface of the floor panel 182*a* is generally coplanar with a surface of the floor joist 152*a* and approximately co-planar with floor panels 180 of the shell 101.

Figure 5A:
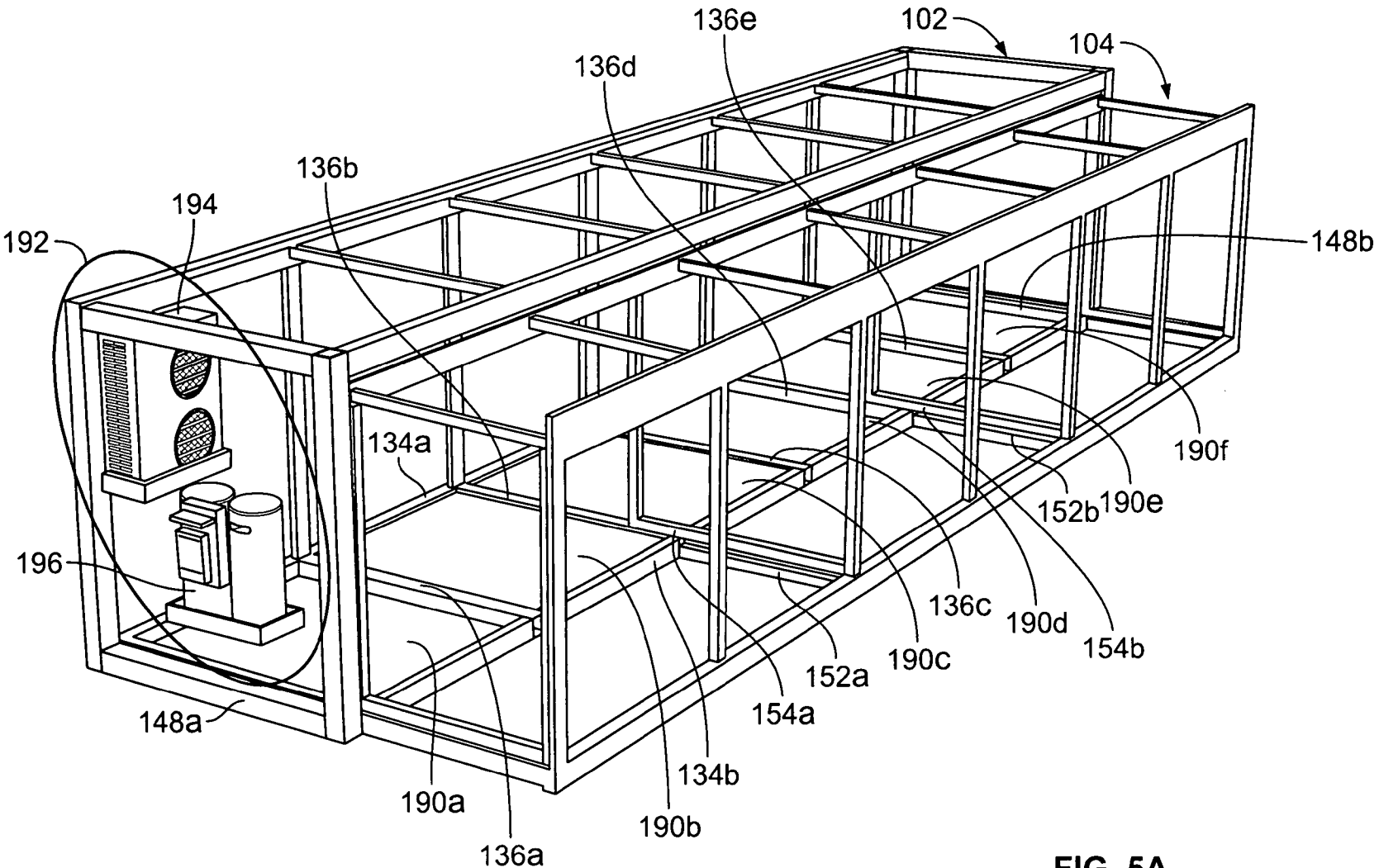
FIG. 5A is a perspective view of the prefabricated structure showing the connection of water tanks between joists of the shell frame.
Figure 5C:
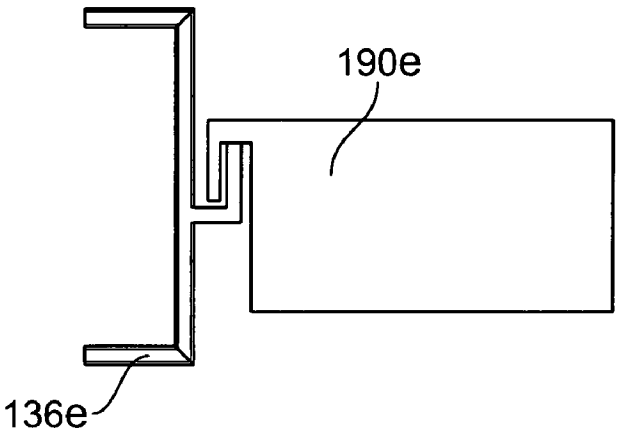
FIG. 5C illustrates complementary structures extending from the joists and the water tank so that the water tank is suspended between adjacent joists.
Figure 5B:
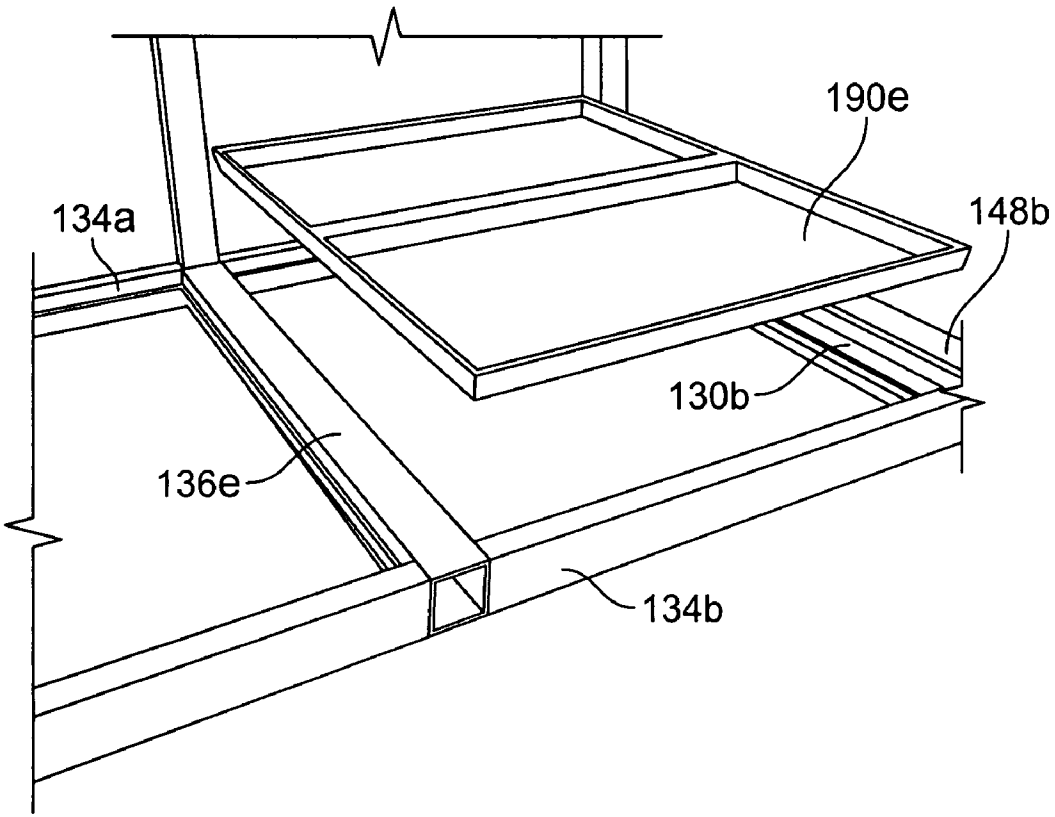
FIG. 5B perspective view of a water tank positioned between and above the joists.

Referring to FIGS. 5A-5C, floor joists 136*a*-136*e* and floor beams 148*a,b* of the shell frame 102 can be used to position support structures below floor panels of the shell 101. The floor joists 136*a*-136*c* and the floor beams 148*a,b* can include lock structures resembling the lock structures of the extension floor joists 152*a,b*. Between a pair of floor joists 136*a*-136*c*, or a floor beam 148*a,b*, one of a supply water tank for providing water to the prefabricated structures (e.g., to appliances) and a grey water tank for receiving used water for filtering and dumping and/or recycling can be positioned. The tank 190*e* of FIG. 5B is shown open for illustration of the geometry of a typical tank. However, in embodiments of the present invention, supply water tanks and grey water tanks will be enclosed. Further, the tank 190*e* includes a single dividing structure dividing the tank to at least partially control movement of water within the tank. In further embodiments, a supply water tank and/or grey water tank of the prefabricated structure can be baffled to further control movement of water in the tank. Controlling movement of water within the tank can resist catastrophic unbalancing of the prefabricated structure during periods of high winds, such as during tropical storms or hurricanes. Water within the tank can add weight to the prefabricated structure while lowering a center of gravity of the prefabricated structure, thereby increasing stability of the prefabricated structure. In a preferred embodiment shown in FIG. 5A, the prefabricated structure can include four supply water tanks and two grey water tanks, so that water tanks are positioned along substantially the length of the shell 101. Referring to FIG. 5C, the tanks can be supported by locking structures of the floor joist 136*e* that complement structures of the tank 190*e*. As shown, the tank is supported so that a top of the tank is below the surface of the floor joist 136*e*. Floor panels (180 in FIG. 4A) of the shell 101 can be positioned above the tanks so that the floor panels 180 are supported by the tanks 190*a-e* or alternatively by additional features of the floor joists 136*a-e*.

Figure 5F:
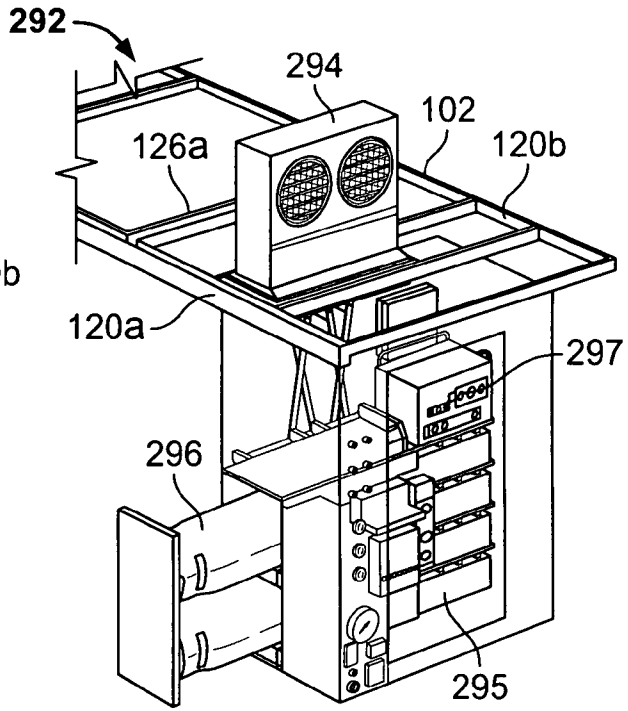
FIGS. 5E and 5F are perspective views of the service pack of FIG. 5D positioned within the shell frame in an undeployed and deployed state.
Figure 5E:
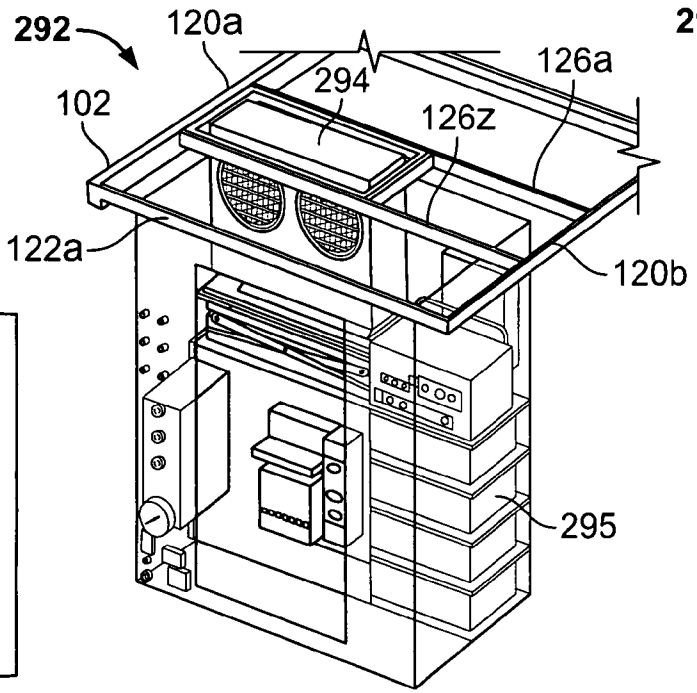
Figure 5D:
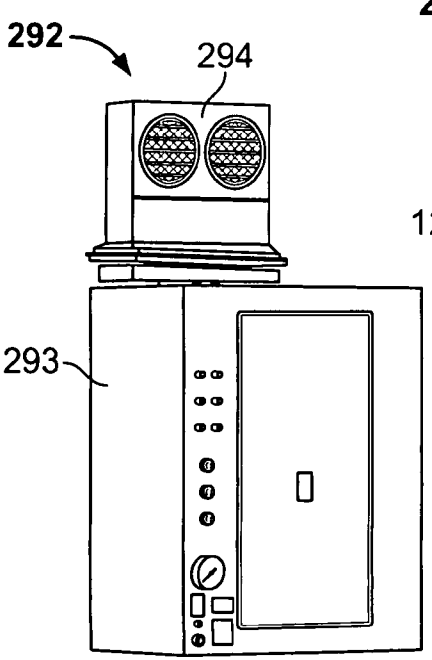
FIG. 5D is a isolated view of a service pack including a heat pump.

Referring again to FIG. 5A, a service pack 192 for use with the prefabricated structure is shown positioned within the shell frame 102. As shown, the service pack 192 comprises a heat pump 194 and propane tanks 196 for use to fuel a generator or utilities such as cooking appliances. Though not shown, the service pack 192 can include batteries, inverter/rectifier equipment, and the aforementioned generator. As shown, the heat pump 194 can be accessed by drawing the heat pump 194 from the end of the shell frame 102 between adjacent columns 124*a*,124*b*. However, the heat pump 194 is typically deployed for long periods of time, and such an arrangement may be disadvantageous, for example where cooperating prefabricated structures are positioned in close proximity to one another. FIGS. 5D-5F illustrates an embodiment of a service pack 292 in accordance with the present invention for use with prefabricated structures as described herein, for example. The service pack 292 comprises a heat pump 294 mounted on a cabinet 293. The cabinet 293 is lockable to prevent components of the service pack 292 from being removed. The heat pump 294 rests on a platform that can be raised through the roof of the shell, as shown in FIGS.

5E and 5F. The shell frame 102 comprises an additional roof joist 126*z* so that the heat pump 294 and a door or other structure (not shown) sealing the roof when the heat pump 294 is in an undeployed position is supported between the additional roof joist 126*z* and the roof joist 126*a* of the shell frame 102 as described above. The heat pump 294 can be raised by a motor or mechanically. With the heat pump raised through the roof of the shell, the heat pump 294 can be left deployed without potentially interfering with additional prefabricated structures that may be placed in close proximity so that the prefabricated structures can cooperate in one or both of electrical and water utilities. Further, the heat pump 294 may function more efficiently when placed above the prefabricated structure, allowing air to more freely circulate around the heat pump 294. Fuel tanks such as propane tanks 296 can be drawn from the front of the shell 296. Because fuel tanks 296 are only accessed briefly for replacement, the fuel tanks 296 do not protrude from the shell when not serviced. The cabinet 293 also contains a bank of batteries 295 that are recharged by electrical wiring connected with solar panels of the extension roof and/or by a generator that can be fueled by the propane tank 296. The cabinet 293 also includes inverter and/or rectifier equipment 297 to convert DC to AC and AC to DC. Use of a unified or partially unified service pack 292 can increase likely reusability of service components of the prefabricated structure, for example when the prefabricated structure is refurbished for deployment at an alternative site.

Figure 6A:
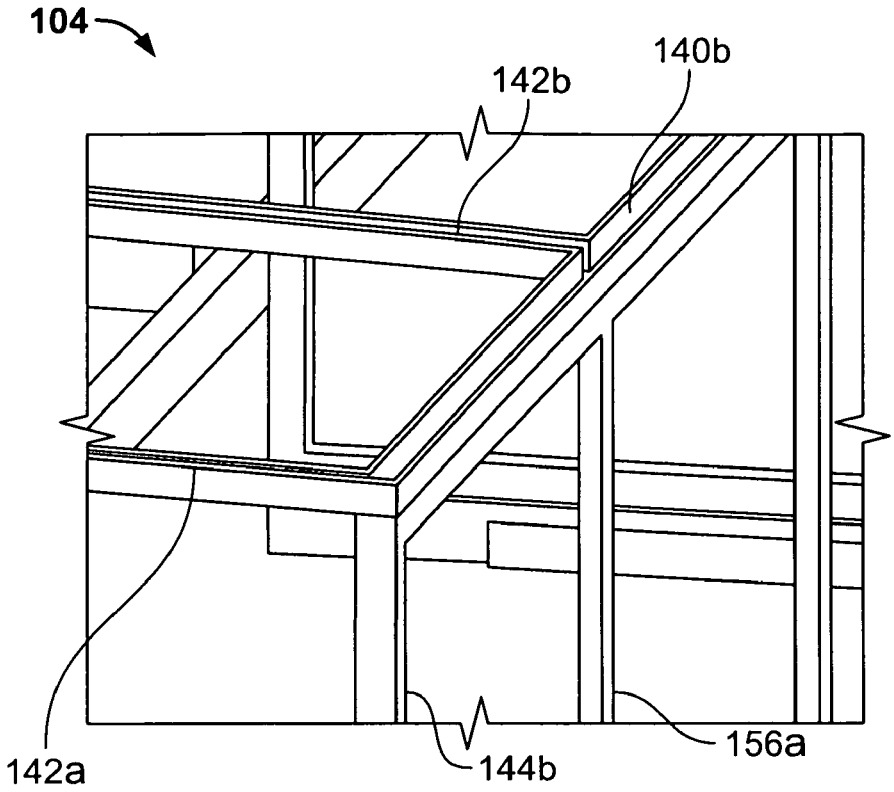
FIG. 6A is a partial perspective view of the extension frame having channels extending through beams and joists of the roof support of the extension.
Figure 6B:
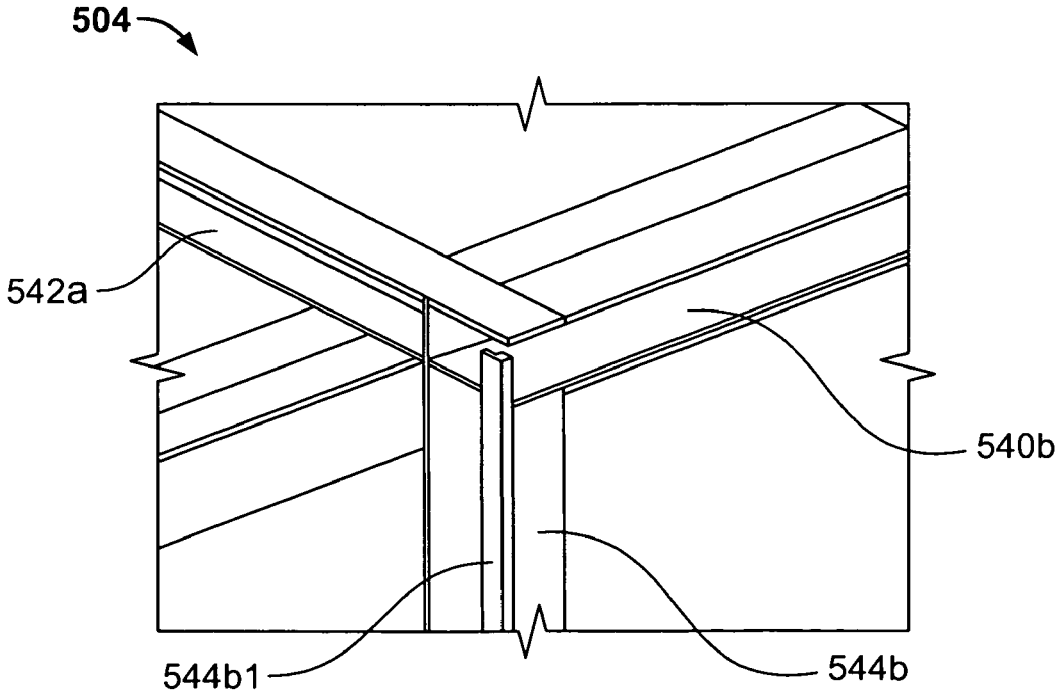
FIG. 6B is a partial perspective view of the extension frame of an alternative embodiment of a prefabricated structure in accordance with the present invention having channels extending through the face of the beams and vertical structures of the extension frame.
Figure 6C:
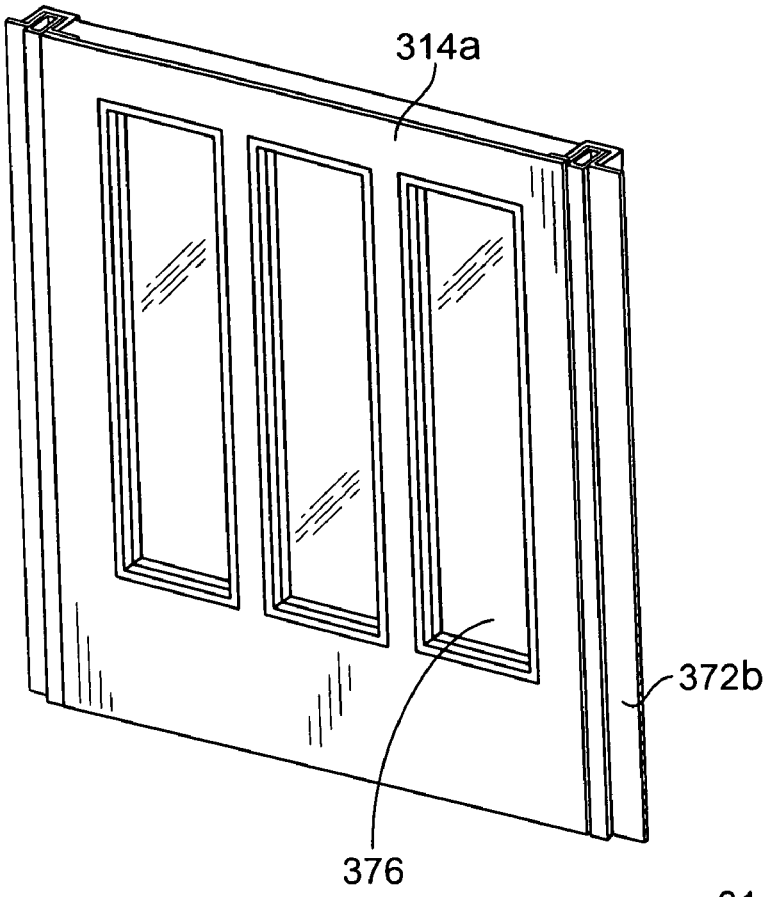
FIGS. 6C-6E are perspective views of a panel and a connection system for meeting the panel with of the prefabricated structure of FIG. 1A.
Figure 6D:
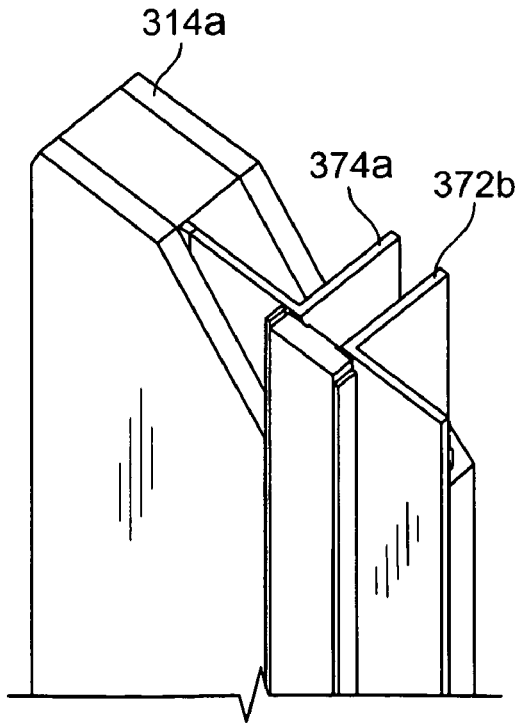

The shell frame 102 and extension frame 104 can provide channels for communicating one or both of electrical wiring and water ducts. FIG. 6A illustrates an extension frame 104 of embodiments such as shown in FIGS. 1A-5E. Electrical wiring can communicate, for example, electrical power collected from a solar panel arranged on a roof of the extension to a battery or bank of batteries, and can communicate electrical power from the battery or bank of batteries to lighting and/or outlets of the prefabricated structure. Electrical wiring can be connected between the extension 103 and the shell 101 as a single harness that extends through both frames when deployed or undeployed, or alternatively the electrical wiring can exist as separate harnesses extending through the shell 101 and extension 103, respectively, that can be connected upon deployment of the extension 103 from the shell 101. The electrical wiring rests or is seated within channels, for example as defined by roof beams 140*b*,142*a* of the extension frame 104. Roofing can overlay the channels to protect electrical wiring from environmental elements. Such an arranged can protect electrical wiring and water ducts from damage during transport and use and can provide improved aesthetics by hiding electrical wiring and water ducts. In alternative embodiments, the extension frame 504 can comprise channels within roof beams 542*a*,540*b* arranged differently than as shown in FIG. 6A. For example, the channels can face outwardly.

Figure 6E:
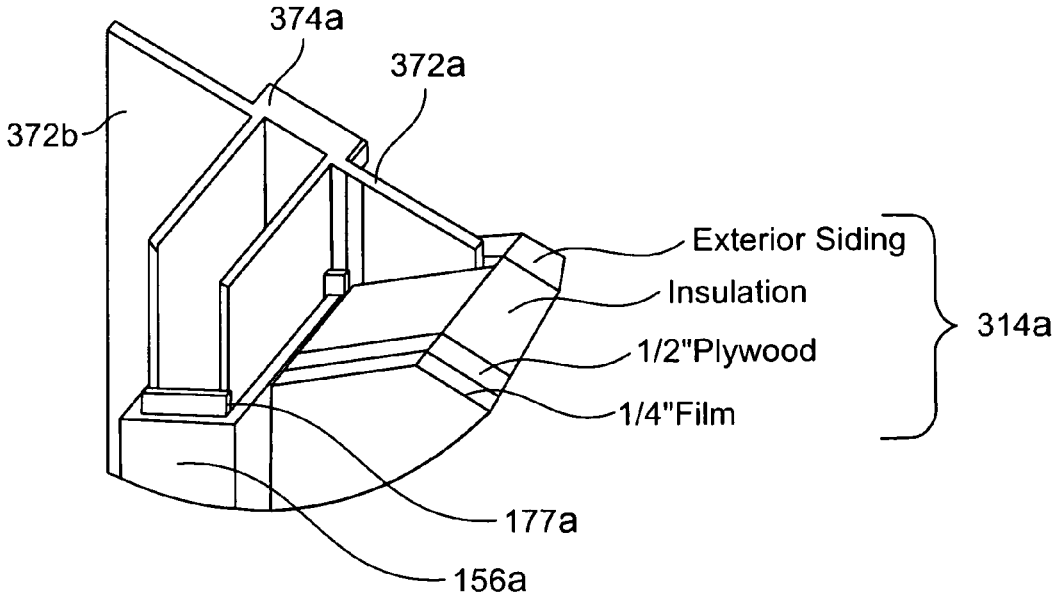
Figure 6F:
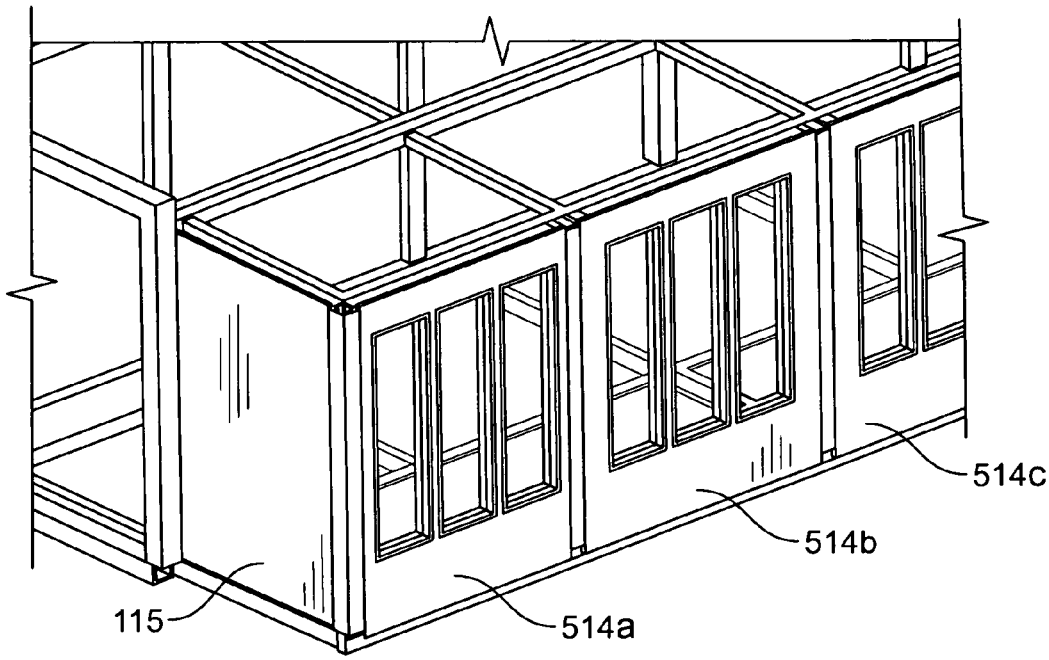
FIG. 6F is a perspective view of the prefabricated structure showing a plurality of panels made it with the extension frame.
Figure 6G:
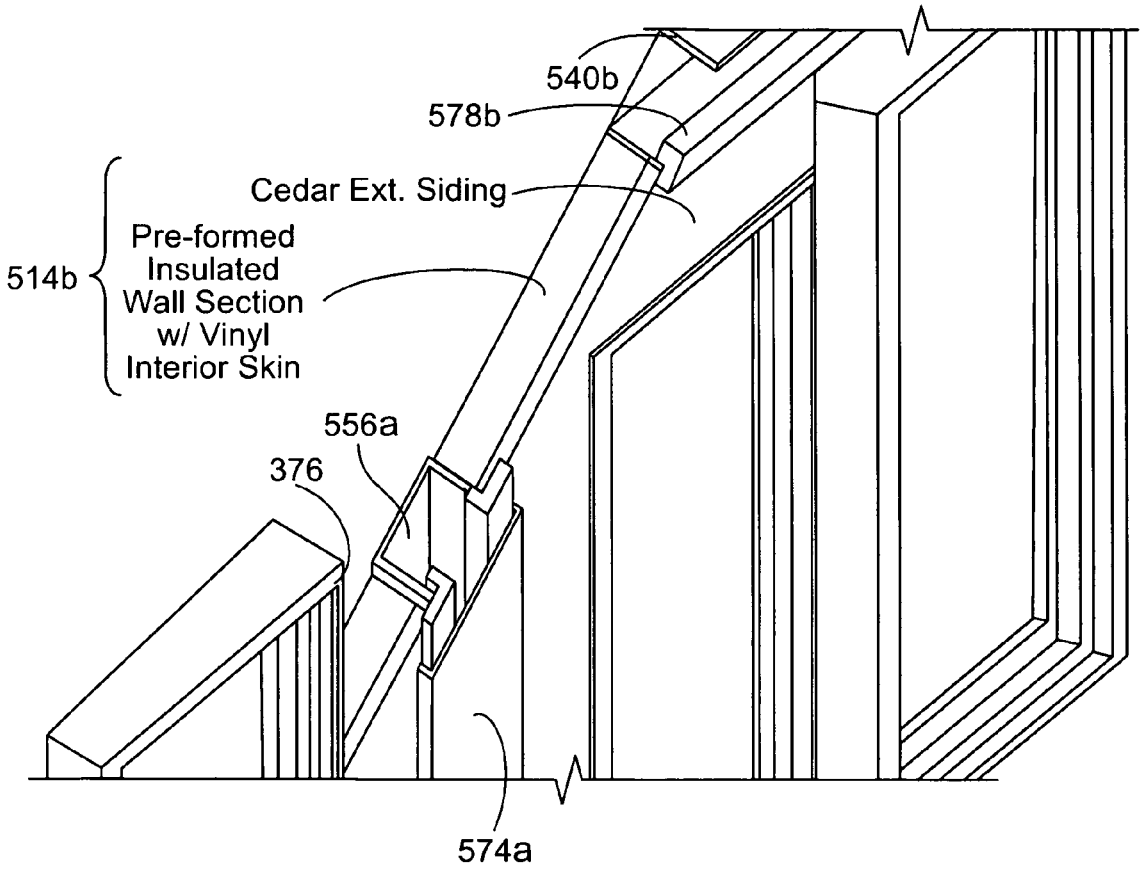
FIG. 6G is a perspective, partial cross-section of adjacent panels connected at a vertical structure of the extension frame.

Vertical structures of both the shell frame 102 and the extension frame 104,504 can comprise C-channels adapted to receive L-channels 372*a*,372*b* fixedly embedded in panels 314*a* or fixedly connected with panels 314, as shown in FIGS. 6C-6G. Embodiments of prefabricated structures in accordance with the present invention can be configured to suit myriad different applications and tasks using the shell frames 102 and extension frames 104,504 described above, by selecting and mating panels having suitable features with the shell frame 102 and extension frame 104,504. The panel 314*a* of FIG. 6C resembles panels 314 of FIGS. 1E and 1F, and includes three windows 376 that extend along a large portion of the height of the panel 314*a*. The panel 314*a* can comprise, in an embodiment, a structure insulated from environmental elements such as rain and wind. The panel 314*a* can further resist heat exchange between air within the prefabricated structure and the environment, helping to reduce heating of the prefabricated structure by hot outside air, and cooling of the prefabricated structure by cold outside air. The panel 314*a* can comprise any material or combination of materials that allow an L-channel to be embedded or fixedly connected with the panel 314*a*, and that provides at least insulation from moisture and wind. For example, as shown in FIG. 6E, the panel can include exterior siding bonded to insulation, bonded to a light, rigid material such as plywood which is sealed by a film, such as vinyl. As shown, the L channel 372*a*,372*b* is fixedly embedded between the exterior siding and insulation of the panel 314*a*. The panel 314*a* can be mated with adjacent vertical structures 156*a* so that the L-channel 372*a*,3732*b* fits in the C-channel of the vertical structure 156*a* and the C-channel is seated between the panel 314*a* and the L-channel 372*a*. A seal 177*a* can be bonded, for example adhesively, with the C-channel so that the L-channel presses against the seal 177*a*, preventing environmental elements from penetrating the prefabricated structure. A shim 374*a* can be placed between panels 314*a* to force panels 314*a* against opposite sides of the C-channel 156*a*, improving the seal. An alternative embodiment of a panel is shown in FIGS. 6F and 6G comprising an L-channel bonded to an exterior of a panel 514*b* rather than embedded. The shim 574*a* caps adjacent L-channels rather the urging them apart. The panel 514*b* of FIGS. 6F and 6G further comprises an L-channel 578*b* mating with a roof beam 540*b* of the extension frame. The window 376 of the panel is shown partially separated from the panel 514*b*.

Figure 7B:
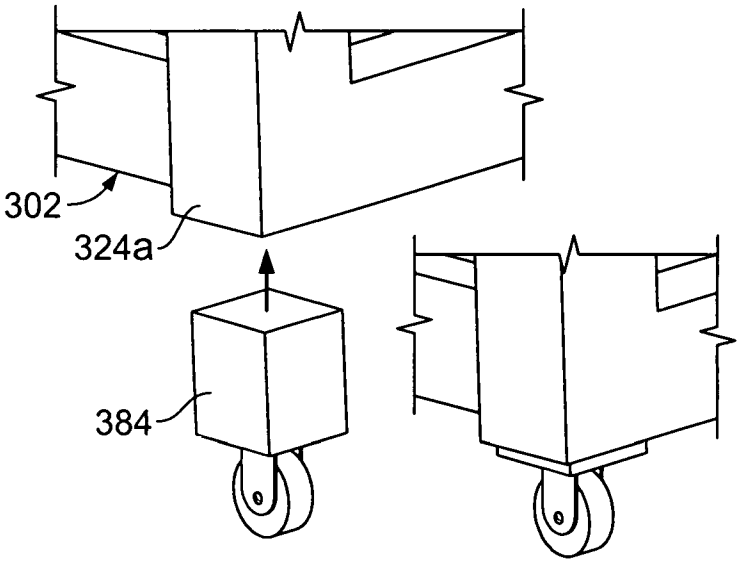
FIG. 7B illustrates a roller joined with the shell frame of the prefabricated structure.
Figure 7A:
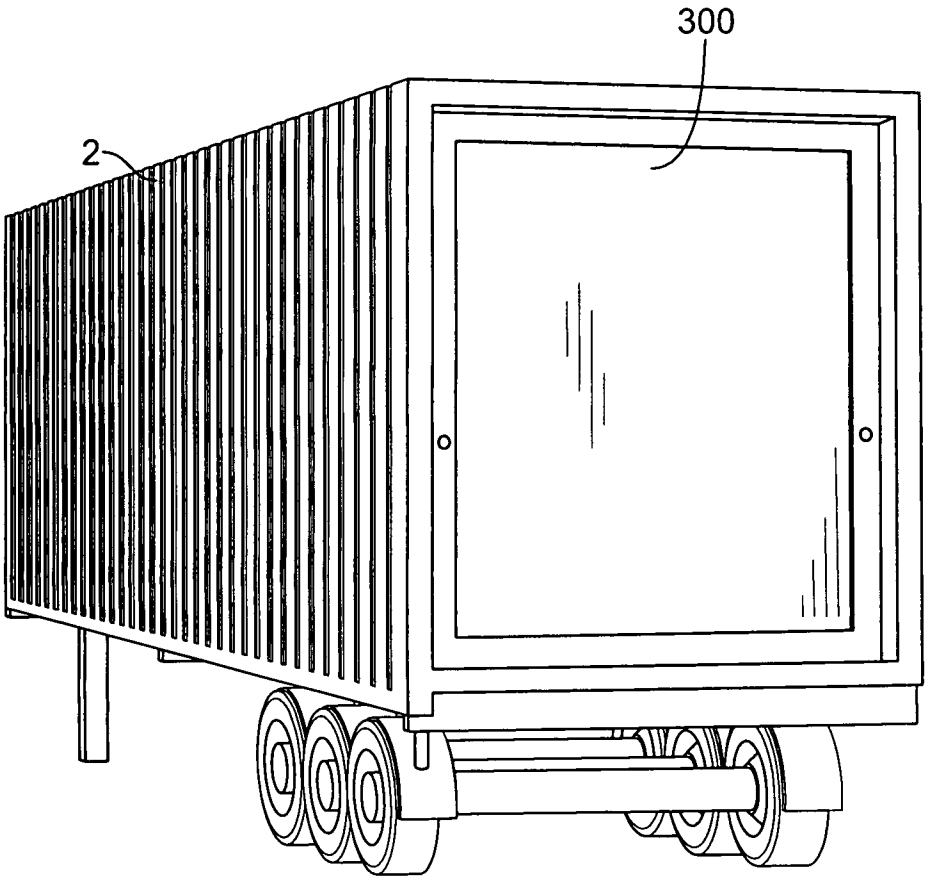
FIGS. 7A, 7C, and 7E-7G illustrate progressive steps of an embodiment of a method of deploying the prefabricated structure of FIG. 1A in accordance with the present convention.
Figure 7D:
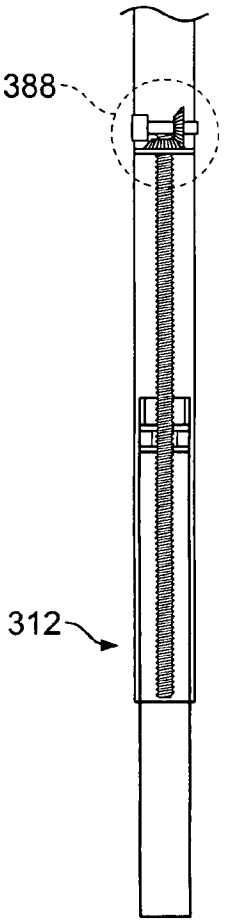
FIG. 7D is a schematic view of a support post showing a mechanism for actuating the support post.
Figure 7C:
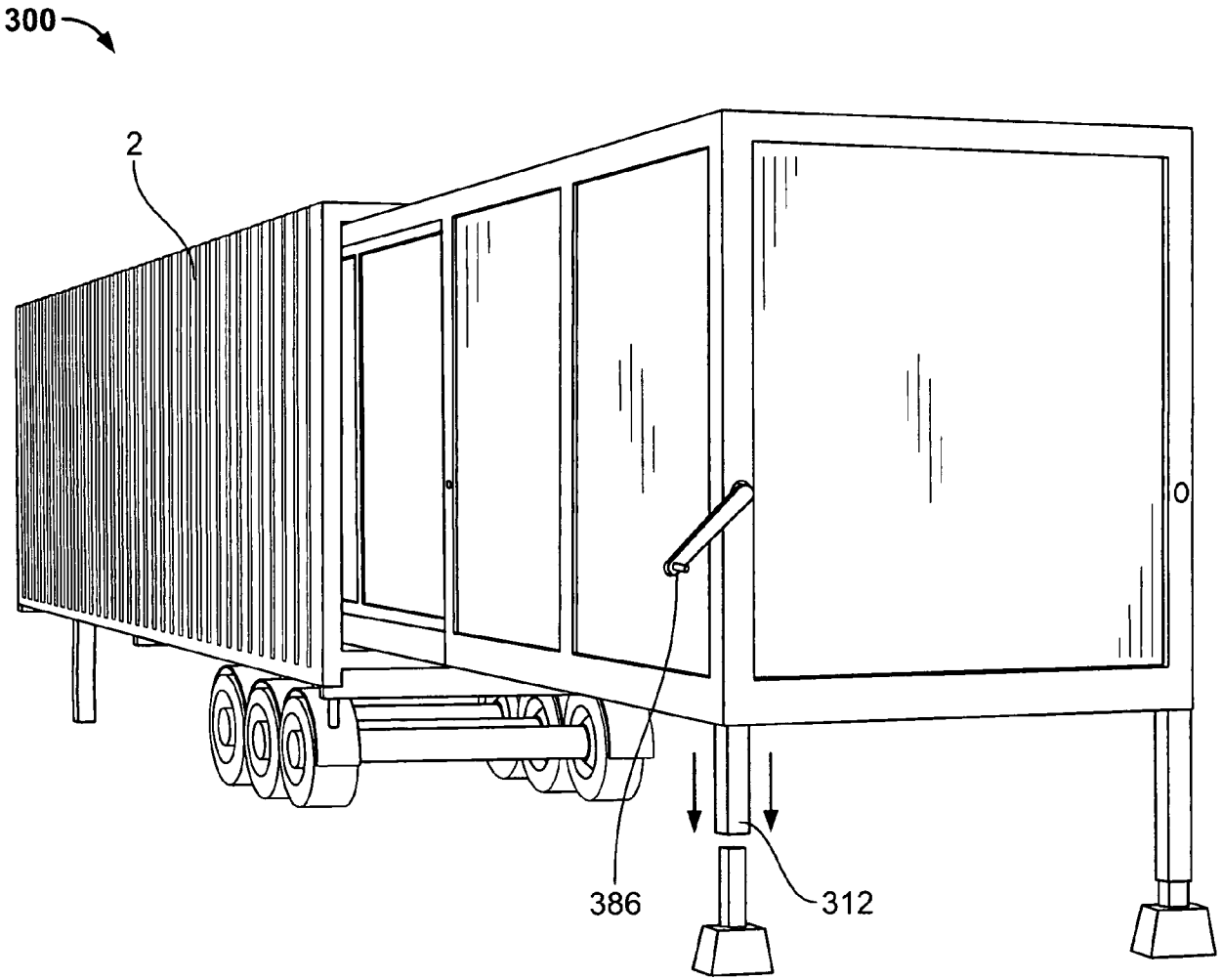
Figure 7E:
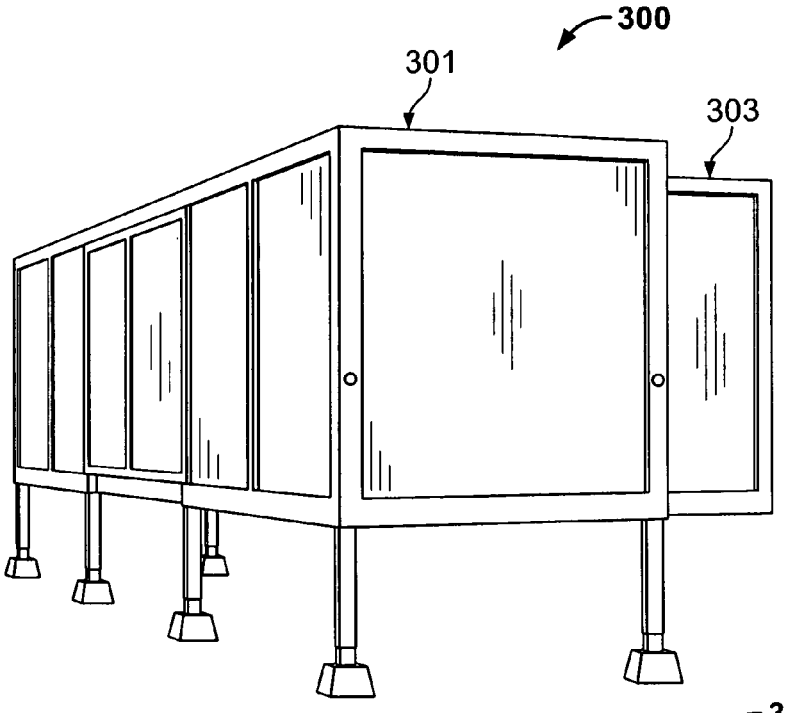
Figure 7F:
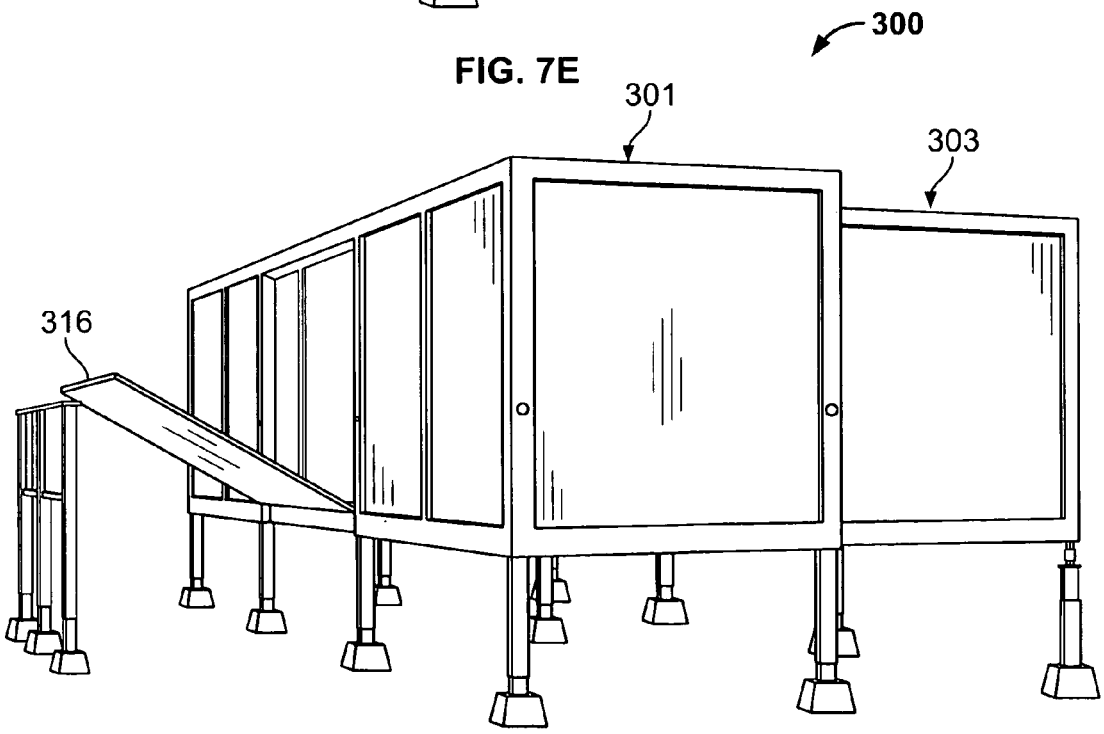
Figure 7G:
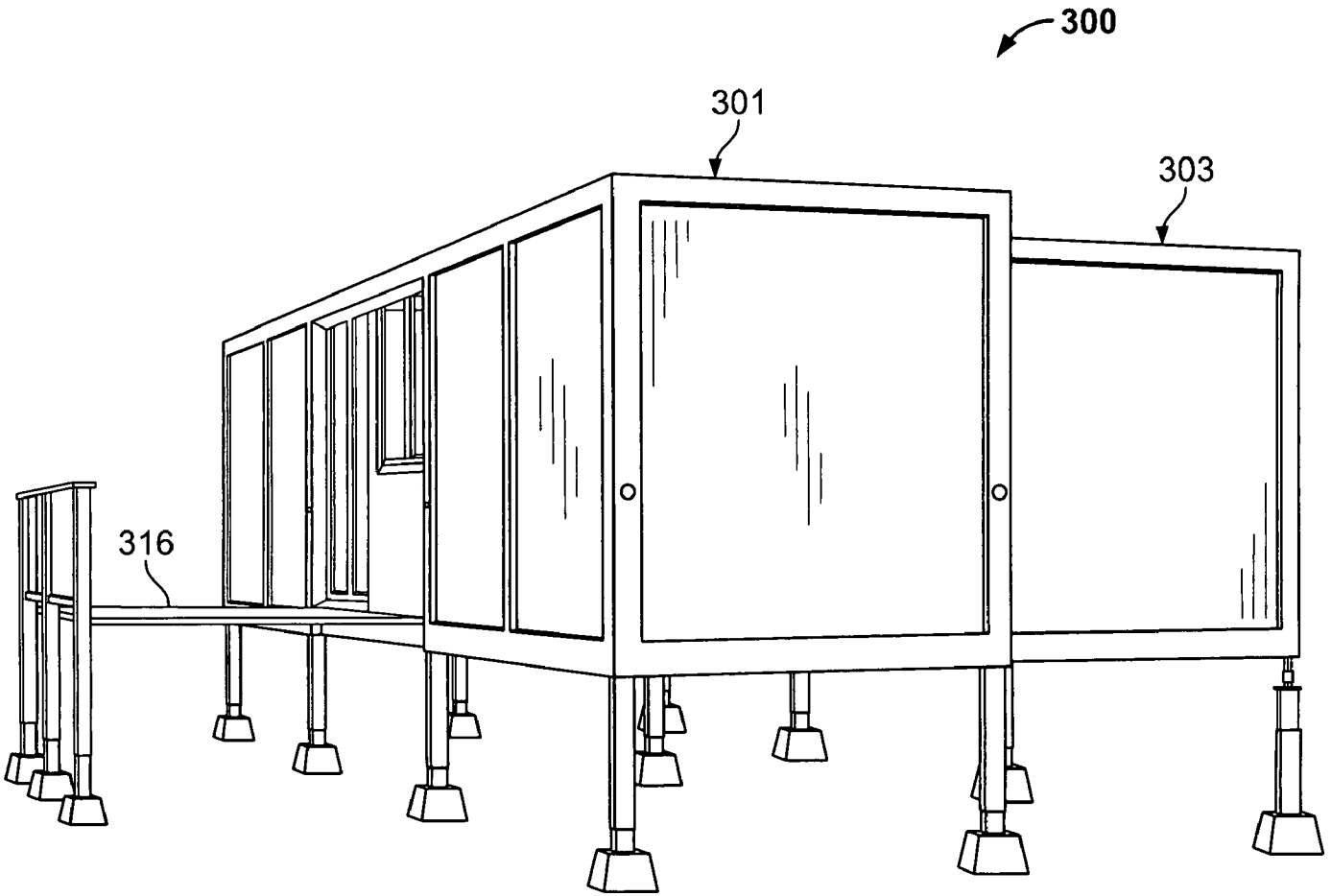

FIGS. 7A-7G illustrate an embodiment of a method of deploying a prefabricated structure 300 including a shell and an extension nested within the shell in accordance with the present invention. The method comprises positioning a container 2 or support surface such as a flat-bed or rail car supporting the prefabricated structure at a site. The prefabricated structure 300 can be supported on a plurality of rollers 384 and/or casters connected with the prefabricated structure 300. The prefabricated structure 300 can be urged so that a first set of roller 384 extends from the container 2. As shown in FIG. 7B, the first set of rollers can be separated from columns of the prefabricated structure 300. A first set of support posts 312 can be lowered from the columns. The support posts 312 can be lowered, in an embodiment, using a worm gear device 388, such as shown in FIG. 7D. A crank 386 can be mated with a gear 388 arrangement and rotated to lower the support post 312. In alternative embodiments, the support post 312 can be lowered using a motor. Once the support posts 312 are lowered, the support posts 312 can be anchored. The prefabricated structure 300 is then drawn from the container 2 or support structure so that more of the prefabricated structure 300 is cantilevered out from the container 2 or support structure. Preferably, the prefabricated structure 300 is drawn so that a column of the shell is cantilevered from the support surface. In a fashion repeated at each pair of columns along the shell, a set of rollers or casters is cantilevered from the support surface, and separated from the column. Support posts are then lowered from the column and anchored at the site. Referring to FIGS. 7E and 7F, once the prefabricated structure 300 has been drawn from the support surface, the extension 303 can be deployed from the shell 301. In a preferred embodiment, a rack-and-pinion mechanism can be employed to urge the extension 303 from the shell 301. The rack-and-pinion mechanism can comprise a shaft extending from the floor beams of the shell and through the floor joists of the shell, the shaft including pinions mating with racks at each or several of the floor joists and floor beams of the shell. The extension 303 can be cantilevered from the shell 301 in a fully deployed position. Once the extension is deployed, support posts of the extension 303 are extended from columns of the extension 303. The support posts are then anchored. Referring to FIGS. 7F and 7G, the deck 316 can be deployed, for example to be mated with a set of support posts.

In alternative embodiments, the prefabricated structure may be suspended by way of cables attached to eyehooks over a designated deployment site. The prefabricated structure may be held suspended over the site by a crane or other device while support posts are extended from columns of the shell and anchored in position at the site. Once the support posts are extended, the extension can be deployed from the shell. After deployment of the extension, support posts of the extension can be lowered an anchored in position at the site. In still further embodiments, the prefabricated structure can be positioned over a site by a forklift. The prefabricated structure may be held suspended over the site by the forklift while support posts are extended from columns of the shell and anchored in position at the site. As above, once the support posts are extended, the extension can be deployed from the shell. After deployment of the extension, support posts of the extension can be lowered an anchored in position at the site.

It should be noted, and will be apparent upon review of FIGS. 1A-1F described above, that the prefabricated structure 300 itself can act as a container. When the extension 303 is nested within the shell 301, the prefabricated structure is sealed. Embodiments of prefabricated structures in accordance with the present invention are advantageously designed to be moved without a sheltering container, so that prefabricated structures can be placed directly on flatbeds, railroad cars, cargo ships, etc. without first being placed in containers. Such a scheme for transporting the prefabricated structure can reduce transport and setup time, simplify setup and reduce an amount of space required for setup (the prefabricated structure need not be drawn lengthwise from a semi-truck, for example). Further, as noted above the columns of the shell frame can include detachable eyehooks and rollers that are fitted at mounting points within the columns. Columns provide opportune locations for locking additional prefabricated structures in place when stacked for transport on a cargo ship, for example. Thus, multiple prefabricated structures can be stacked as high as can be supported by their frames (which can vary with materials selected for the frame) and transported on cargo ships to deliver to disaster relief sites, such as in Thailand and Indonesia following the Boxing Day tsunami, or Africa to assist relief efforts for refugees in Darfur, Sudan.

Embodiments of methods of using prefabricated structures and systems of cooperating prefabricated structures in accordance with the present invention can be applied to provide potential logistical solutions to multiple logistical challenges, for example encountered at a disaster area. The system can comprise two or more cooperating prefabricated structures, each prefabricated structure including a shell and a deployable extension. The prefabricated structures can cooperate in one or more ways. Cooperation can be simple, for example, the prefabricated structures can include decks that are sufficiently close to one another so as to combine to form a common walkway. Alternatively, cooperation can determine a selection of panels (e.g., window height, entry positioning and type) for the shell and extension, and the type of amenities and furniture contained within the prefabricated structures. For example, referring to FIG. 8, an embodiment of a system of cooperating prefabricated structures in accordance with the present invention is shown comprising eight prefabricated structures connected together and providing utility for multiple different logistical challenges. The system as shown comprises eight units that are arrangeable as desired to support efficient logistical flow, and the prefabricated structures are sized to be deployed as a system in a tightly configured arrangement. Thus, for example, a length of two deployed prefabricated structures is approximately equal in distance as a width of two deployed prefabricated structures and a length of one deployed prefabricated structure. Thoughtful dimensioning of the prefabricated structure to generally conform with shipping standards, as well as with deployment configurations can enable a cooperating relationship that is substantially complete upon deployment of the prefabricated structures individually. The cooperating relationship and tight configuration of units allows compact, efficient deployment, safety of use by design (e.g., little to no gaps in walkways formed by pivotably deployed decks), and improved logistical flow. The configuration also allows electrical utilities and water utilities to be predictably linked. The system of cooperating prefabricated structures of FIG. 8 can be expanded or reduced in a scaling fashion, so that in an alternative embodiment only the four inner prefabricated structures are linked together (e.g., the two prefabricated structures in the center and the two prefabricated structures arranged perpendicularly to the center structures).

Referring again to FIG. 8, as shown, the system comprises a pair of bunk units ("ERU-BUNK") positioned at opposite ends of the system. The bunk units can include amenities and furniture resembling the prefabricated structure of FIGS. 1C and 1D, for example. The system also comprises an administration unit ("ERU-ADMIN") that includes amenities and furniture resembling the prefabricated structure of FIG. 1E. The system also comprises a medical unit ("ERU-MED") positioned between the bunk units and opposite the administration unit. The medical unit can include amenities and furniture resembling the prefabricated structure of FIG. 1F. In addition to prefabricated structures having previously described amenities, furniture, and functionality, myriad different functional configurations can be provided to prefabricated structures including shell frames and extension frames as described above.

Figure 8:
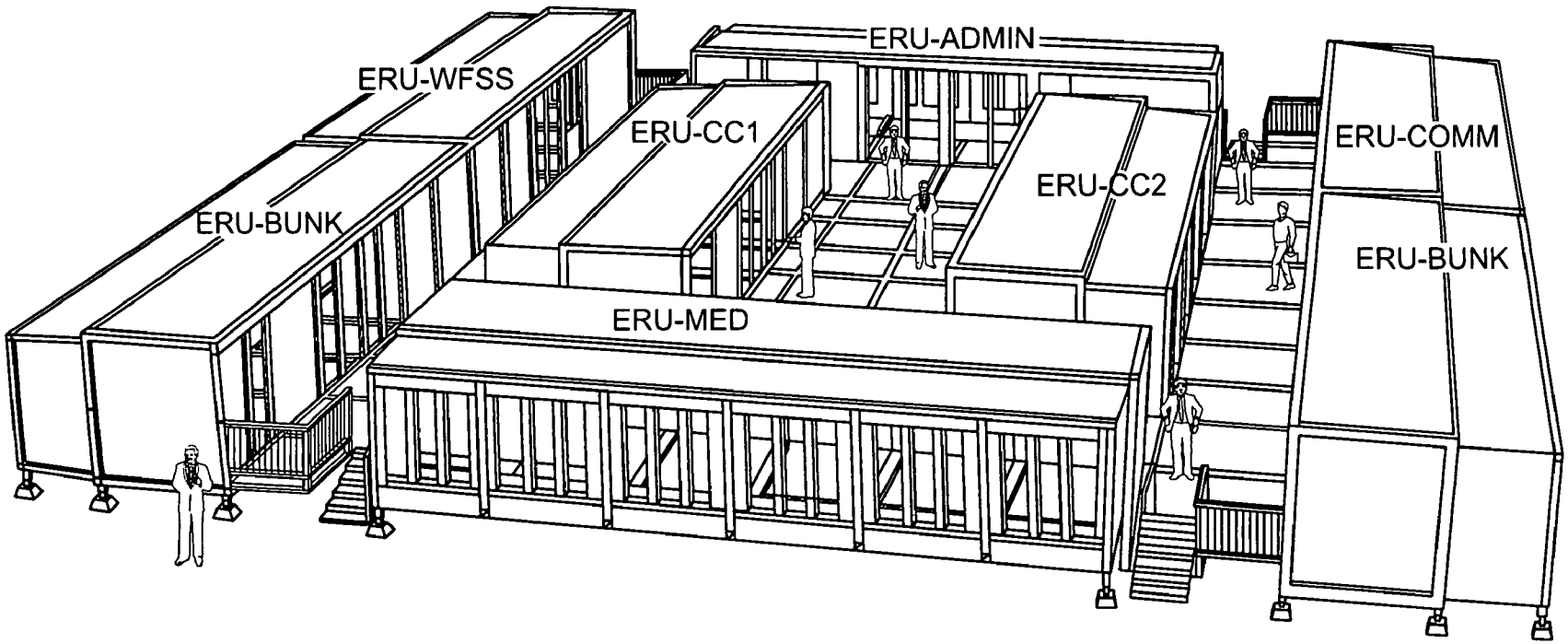
FIG. 8 is a representation of an embodiment of a system of cooperating prefabricated structures in accordance with the present invention.

As shown in FIG. 8, two commissary units ("ERU-CC1 & 2") are provided to facilitate meetings and provide waiting areas for visitors to the administration unit and medical unit, for example. Further, an additional, dedicated communication unit ("ERU-COMM") is shown which can provide a common hub data uplink/downlink and communication. For example, the communication unit can include broadcast transmitting and receiving equipment. Where desired, one or more of the prefabricated structures can electrically and communicatively connected to each other so that the prefabricated structures combine to provide a shared power grid. Such an arrangement can provide flexible distribution to electricity, allowing electrical power to be prioritized to one of the prefabricated structures of the shared grid. For example, medical units or communication units may be given priority where power is low. One or both of the shell frame and the extension frame of the prefabricated structures can include channels that can be accessed, allowing wire harnesses or electrical cables to be connected with other prefabricated structures.

Further, an additional, dedicated water filtering unit ("ERU-WFSS") is shown which can provide a common supply water collection, filtration and distribution facility, as well as a grey water processing and dump facility. A water filtering unit can increase an overall volume of water available and provide more efficient processing of supply water that may be collected from rain water or bottled water provided by relief agencies, etc., by providing a larger and more flexible space for including equipment. Likewise, grey water can be collected from use, treated and dumped, for example in a ditch or cesspool (although the water may be sterile and usable for example for growing foods). One or more of the prefabricated structures can be connected with the water filtering unit so that the prefabricated structures combine to provide a shared water system. Such an arrangement can potentially increase an overall available amount of water by allowing dedication of water tanks in some of the prefabricated structures to supply water, for example, while the water filtering unit quickly filters and disposes of grey water.

Figure 9:
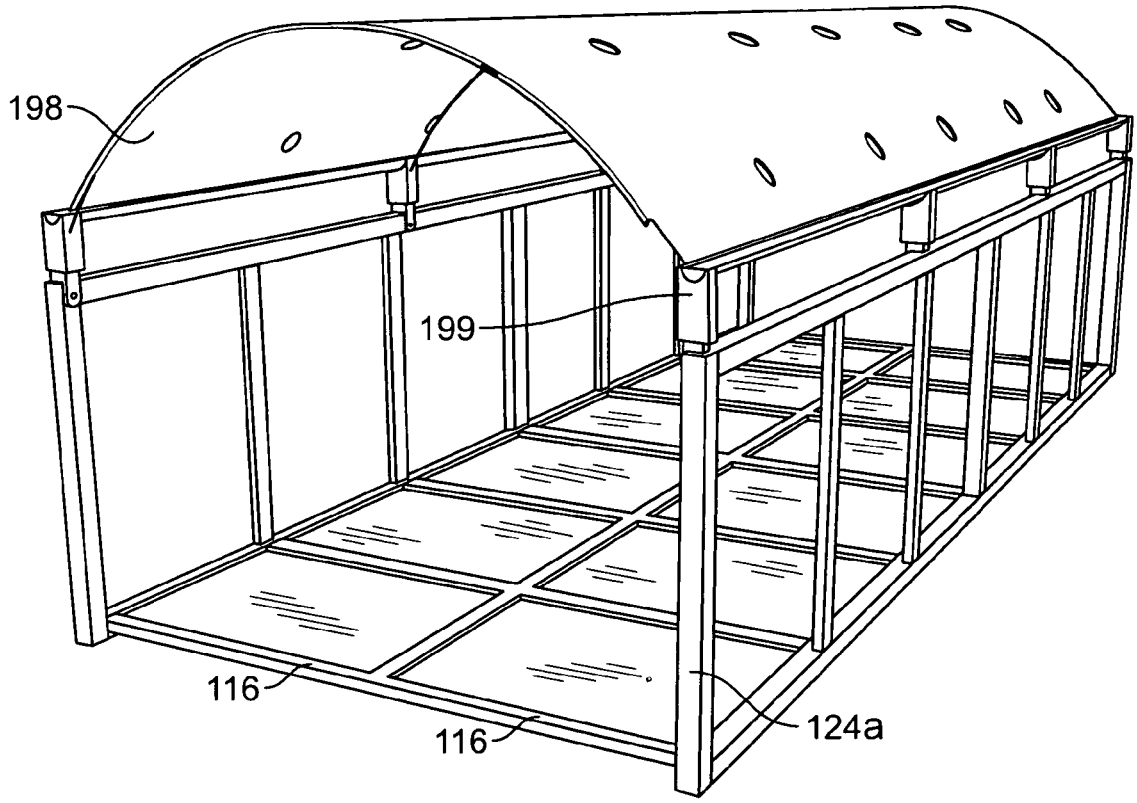
FIG. 9 the perspective view of a walkway canopy structure capable of directing precipitation into a water channel for filtration and use.

As mentioned above, the water filtering unit can collect rain water and filter the water for use by the prefabricated structures. Referring to FIG. 9, one or more of the decks providing walkways for the system can further include canopies 198 anchored to columns 124*a* of the shell frame 102, for example, the canopies 198 providing shade to the walkways and shielding the walkways from rainfall. In such embodiments, the canopies 198 can include mounting structures 199 that direct water beading and rolling from the canopies 198 to gutters and to tubing housed in channels of the shell frames and/or extension frames of the prefabricated structures. The tubing can communicate the water to supply water tanks, or alternatively to the water filtering unit.

Embodiments of methods of distributing a prefabricated structure in accordance with the present invention can be applied to manage construction and deployment costs associated with the prefabricated structures and systems of cooperating prefabricated structures. A method can comprising providing a prefabricated structure for use at a first site, the prefabricated structure including a shell with a shell frame, a plurality of wall panels mated with the shell frame, and a plurality of floor panels mated with the shell frame, and an extension with an extension frame, a plurality of wall panels mated with the extension frame, and a plurality of floor panels mated with the extension frame. The prefabricated structure can be used at a site, such as a disaster relief site, and then recovered from the site for refurbishment. Recovery can comprise a series of steps approximately reversed from the steps of deployment. For example, a prefabricated structure can be recovered by retracting the support posts of the extension into the extension, nesting the extension within the shell, retracting a first set of supports posts of the shell into the shell, joining a rollers to columns of the shell, urging a transport surface so that the set of roller is positioned on the transport surface and can roll on the surface. One of the transport surface and the shell is urged in stages at each pair of columns so that the support posts can be retracted within the column and replaced with rollers that can transfer weight of the prefabricated structure to the transport surface, until the prefabricated structure is wholly received on the transport surface. The prefabricated structure can then be transported back to a refurbishment facility and refurbished. Refurbishment may include replacing one or more floor panels and/or wall panels, amenities and/or furniture. Prefabricated structures can be refurbished so as to support a different use or the same use. It is generally believed that the shell frame extension frame is likely to be undamaged, enabling multiple uses of the prefabricated structure at multiple sites.

The foregoing description of the present invention has been presented for purposes of illustration and description. It is not intended to be exhaustive or to limit the invention to the precise forms disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

The invention claimed is:

1. A prefabricated structure, comprising:

a shell including a shell frame comprising:

a floor support including:

a pair of floor beams extending lengthwise along the shell, and a pair of slotted beams extending between and transverse to the floor beams, a roof support including:

a first pair of roof beams extending lengthwise along the shell, and a second pair of roof beams extending between and transverse to the first pair of roof beams, and four columns extending between the floor support and the roof support and forming four corners of the shell frame;

a flange extending from each of a pair of the columns;

an extension deployable from the shell, the extension including an extension frame comprising:

a floor support including:

a main floor beam extending lengthwise along the extension, and a pair of extension floor beams extending from the main floor beam toward the shell and telescoping from corresponding slotted beams of the shell, a roof support including:

a pair of roof beams extending lengthwise along the extension, and a pair of roof joists extending between and transverse to the first pair of roof beams, and four columns extending between the floor support and the roof support and forming four corners of the extension frame;

an outer lip associated with a pair of columns of the extension farthest from the shell when the extension is deployed; and an inner lip associated with a pair of columns of the extension closest to the shell when the extension is deployed;

wherein the slotted beams of the shell floor support each include a slot through which a column connected between an extension floor beam and an extension roof extends when the extension is seated within the shell;

wherein the flange provides:

a first pocket for receiving the outer lip when the extension is seated within the shell, the first pocket including a first gasket to seal the prefabricated structure when the outer lip is received within the first pocket; and a second pocket for receiving the inner lip when the extension is deployed from the shell, the second pocket including a second gasket to seal the prefabricated structure when the inner lip is received within the second pocket.

2. The prefabricated structure of claim 1, further comprising:

a roof joist extending transverse to and between the first pair of roof beams of the shell and arranged between the second pair of roof beams of the shell;

a ledge extending transversely from a roof beam of the extension toward the shell, the ledge being aligned with the roof joist of the shell frame and a wall base;

a column extending between the wall base and the ledge; and one or more rollers connected with the ledge and biased against the roof joist.

3. The prefabricated structure of claim 1, wherein:

the shell frame comprises a plurality of floor joists extending between and transverse to the floor beams and arranged between the slotted beams;

the shell further includes:

a supply water tank connected between a pair of floor joists or a floor joist and a slotted beam, and a grey water tank connected between a pair of floor joists or a floor joist and a slotted beam; and the shell frame is a channel to communicate a supply water duct connected with the supply water tank and to communicate a grey water duct connected with the grey water tank.

4. The prefabricated structure of claim 1, further comprising:

an assembly for deploying the extension including:

a shaft extending lengthwise along at least a portion of the shell, a pinion operably associated with the shaft;

a rack communicating with the pinion and operably associated with one or more of the extension floor beams and the extension joist; and a motor operable to rotate the shaft so that the extension is deployed.

5. The prefabricated structure of claim 1, wherein the shell further includes a shell roof supported by the shell roof support and the extension further includes an extension roof supported by the extension roof support; and further comprising:

a battery;

a solar panel mounted on the extension roof, the solar panel being shielded by the shell roof when the extension is seated within the shell; and solar panel wiring adapted to electrically connect the solar panel to the battery; and wherein the shell frame and extension frame cooperate to provide a wiring channel to communicate the solar panel wiring between the solar panel and the battery.

6. The prefabricated structure of claim 1, further comprising:

a floor panel connected with the shell by a hinge to provide a floor for the extension;

wherein the floor panel is undeployed when the extension is seated within the shell;

wherein as the extension is deployed, the floor panel pivots at the hinge; and wherein when the extension is deployed, the floor panel is supported between the main floor beam and the shell.

7. The prefabricated structure of claim 6, wherein:

one or more of the main floor beam, the extension joist, and an extension floor beam; includes a floor groove; and the floor panel includes a complementary structure mateable with the floor groove.

8. The prefabricated structure of claim 1, further comprising:

a plurality of vertical structures extending between the floor support and the roof support of the shell and the extension, the vertical structures including a "C" channel; and a plurality of panels including an "L" channel extending from a side, the "L" channels receivable within the "C" channel of the vertical structures so that the panels can be associated with the shell or extension to form an outer wall.

9. The prefabricated structure of claim 8, wherein:

one or more of the columns include a "C" channel; and the "L" channels of the vertical structures are receivable within the "C" channel of the one or more columns so that the panels can be associated with the shell and extension to form an outer wall.

10. The prefabricated structure of claim 3, wherein the shell further includes:

a toilet;

an incineration device connected with the toilet and suspended between a pair of floor joists or a floor joist and a slotted beam;

wherein the incineration device is activated to incinerate waste received from the toilet.

11. The prefabricated structure of claim 1, wherein:

one or more of the columns extending between the floor support and the roof support of the shell include a cavity for interchangeably receiving a roller to move the prefabricated structure and a support post to anchor the prefabricated structure.

12. The prefabricated structure of claim 1, wherein the shell further includes:

a deck pivotably connected with the shell at a hinge;

wherein when the deck is undeployed, the deck shields at least a portion of the shell.

13. A prefabricated structure, comprising:

a shell including a shell frame comprising:

a floor support;

a roof support; and a plurality of columns extending between the floor support and the roof support and forming corners of the shell frame;

a flange extending from at least one of the columns;

an extension deployable from the shell, the extension including an extension frame comprising:

a floor support;

a roof support; and a plurality of columns extending between the floor support and the roof support and forming at least one corner of the extension frame;

an outer lip associated with at least one column of the extension farthest from the shell when the extension is deployed; and an inner lip associated with at least one column of the extension closest to the shell when the extension is deployed;

wherein the flange provides:

a first pocket that can receive the outer lip when the extension is seated within the shell, the first pocket including a first gasket to seal the prefabricated structure when the outer lip is received within the first pocket; and a second pocket that can receive the inner lip when the extension is deployed from the shell, the second pocket including a second gasket to seal the prefabricated structure when the inner lip is received within the second pocket.

14. The prefabricated structure of claim 13, wherein:

the shell floor support includes:

a pair of floor beams extending lengthwise along the shell, and a pair of slotted beams extending between and transverse to the floor beams;

the shell roof support includes:

a first pair of roof beams extending lengthwise along the shell, and a second pair of roof beams extending between and transverse to the first pair of roof beams;

the extension floor support including:

a main floor beam extending lengthwise along the extension, and a pair of extension floor beams extending from the main floor beam toward the shell and telescoping from corresponding slotted beams of the shell; and the extension roof support including:

a pair of roof beams extending lengthwise along the extension, and a pair of roof joists extending between and transverse to the first pair of roof beams;

wherein the slotted beams of the shell floor support each include a slot through which a column connected between an extension floor beam and an extension roof extends when the extension is seated within the shell.

15. The prefabricated structure of claim 14, wherein:

the shell floor support further includes a floor joist extending between and transverse to the floor beams and arranged between the slotted beams;

the shell roof support further includes a roof joist extending transverse to and between the first pair of roof beams and arranged between the second pair of roof beams;

the extension floor support further includes:

an extension joist extending from the main floor beam toward the shell and telescoping from the floor joist of the shell; and a wall base coplanar with the extension joist and gapped from the extension joist so that the wall base is received over the floor joist when the extension is seated within the shell;

the extension roof support further includes a ledge extending transversely from a roof beam of the extension toward the shell, the ledge being aligned with the roof joist of the shell frame and the wall base; and the extension frame further includes:

a column extending between the wall base and the ledge; and one or more rollers connected with the ledge and biased against the roof joist.

16. The prefabricated structure of claim 14, further comprising:

a plurality of vertical structures extending between the floor support and the roof support of the shell and the extension, the vertical structures including a "C" channel; and a plurality of panels including an "L" channel extending from a side, the "L" channels receivable within the "C" channel of the vertical structures so that the panels can be associated with the shell or extension to form an outer wall.

17. The prefabricated structure of claim 16, wherein:

one or more of the columns include a "C" channel; and the "L" channels of the vertical structures are receivable within the "C" channel of the one or more columns so that the panels can be associated with the shell and extension to form an outer wall.

18. The prefabricated structure of claim 14, wherein:

the shell frame comprises a plurality of floor joists extending between and transverse to the floor beams and arranged between the slotted beams;

the shell further includes:

a supply water tank connected between a pair of floor joists or a floor joist and a slotted beam, and a grey water tank connected between a pair of floor joists or a floor joist and a slotted beam; and the shell frame is a channel to communicate a supply water duct connected with the supply water tank and to communicate a grey water duct connected with the grey water tank.

19. The prefabricated structure of claim 13, wherein the shell further includes a shell roof supported by the shell roof support and the extension further includes an extension roof supported by the extension roof support; and further comprising:

a battery;

a solar panel mounted on the extension roof, the solar panel being shielded by the shell roof when the extension is seated within the shell; and solar panel wiring adapted to electrically connect the solar panel to the battery; and wherein the shell frame and extension frame cooperate to provide a wiring channel to communicate the solar panel wiring between the solar panel and the battery.

20. The prefabricated structure of claim 14, further comprising:

a floor panel connected with the shell by a hinge to provide a floor for the extension;

wherein the floor panel is undeployed when the extension is seated within the shell;

wherein as the extension is deployed, the floor panel pivots at the hinge; and wherein when the extension is deployed, the floor panel is supported between the main floor beam and the shell.

* * * * *